US012788199B2

(12) United States Patent
Li et al.

(10) Patent No.: US 12,788,199 B2
(45) Date of Patent: Nov. 10, 2026

(54) AUTOMATIC CLEANING DEVICE

(71) Applicant: BEIJING ROBOROCK TECHNOLOGY CO., LTD., Beijing (CN)

(72) Inventors: Xing Li, Beijing (CN); Pan Cheng, Beijing (CN); Chuanlin Duan, Beijing (CN); Rongxin Hu, Beijing (CN)

(73) Assignee: BEIJING ROBOROCK TECHNOLOGY CO., LTD., Beijing (CN)

( * ) Notice: Subject to any disclaimer, the term of this patent is extended or adjusted under 35 U.S.C. 154(b) by 434 days.

(21) Appl. No.: 18/276,815

(22) PCT Filed: Feb. 8, 2022

(86) PCT No.: PCT/CN2022/075553
§ 371 (c)(1),
(2) Date: Aug. 10, 2023

(87) PCT Pub. No.: WO2022/171091
PCT Pub. Date: Aug. 18, 2022

(65) Prior Publication Data

US 2024/0130593 A1 Apr. 25, 2024

(30) Foreign Application Priority Data

Feb. 10, 2021 (CN) ..... 202110186817.2

(51) Int. Cl.
*A47L 11/40* (2006.01)

(52) U.S. Cl.
CPC ..... *A47L 11/4036* (2013.01); *A47L 11/4008* (2013.01); *A47L 11/4011* (2013.01); *A47L 11/4063* (2013.01)

(58) Field of Classification Search
CPC ..... A47L 11/284; A47L 11/4036; A47L 11/4052; A47L 11/4058; A47L 11/4066;
(Continued)

(56) References Cited

U.S. PATENT DOCUMENTS 757,831 A * 4/1904 Neidenbach ..... A47L 11/4069 15/49.1
10,524,630 B2 1/2020 Chao
(Continued)

FOREIGN PATENT DOCUMENTS

CN 202699049 U 1/2013
CN 204274328 U 4/2015
(Continued)

OTHER PUBLICATIONS

EP22752251.3—Extended European Search Report.
(Continued)

*Primary Examiner* — C. A. Rivera
(74) *Attorney, Agent, or Firm* — Thomas Horstemeyer, LLP

(57) ABSTRACT

Disclosed is an automatic cleaning apparatus, including: a moving platform configured to move automatically on an operating surface; and a cleaning module disposed on the moving platform, and including: a dry cleaning module configured to clean at least a part of the operating surface by means of dry cleaning; and a wet cleaning module configured to clean at least a part of the operating surface by means of wet cleaning, where the wet cleaning module includes: a cleaning head for cleaning the operating surface, and a driving unit for driving the cleaning head to reciprocate along a target surface, the target surface being a part of the operating surface, where a width of a lateral cleaning area of the cleaning head is smaller than a width of a lateral cleaning area of the dry cleaning module.

6 Claims, 12 Drawing Sheets

(58) Field of Classification Search
CPC .. A47L 11/4038; A47L 11/4041; A47L 11/00; A47L 11/40; A47L 11/4063; A47L 11/4069; A47L 2201/06
See application file for complete search history.

(56) References Cited

U.S. PATENT DOCUMENTS

| | | | |
|---|---|---|---|
| 2006/0190134 | A1 | 8/2006 | Ziegler et al. |
| 2020/0298415 | A1 | 9/2020 | Sun et al. |
| 2021/0015326 | A1 | 1/2021 | James et al. |

FOREIGN PATENT DOCUMENTS

| | | | | | |
|---|---|---|---|---|---|
| CN | 105775473 | A | | 7/2016 | |
| CN | 206324739 | U | | 7/2017 | |
| CN | 107518835 | A | | 12/2017 | |
| CN | 109330497 | A | | 2/2019 | |
| CN | 109549573 | A | | 4/2019 | |
| CN | 109645893 | A | | 4/2019 | |
| CN | 209712777 | U | | 12/2019 | |
| CN | 111035320 | A | | 4/2020 | |
| CN | 111067437 | A | | 4/2020 | |
| CN | 210871330 | U | | 6/2020 | |
| CN | 111588317 | A | | 8/2020 | |
| CN | 112155478 | A | | 1/2021 | |
| CN | 212415639 | U | | 1/2021 | |
| CN | 112806915 | A | | 5/2021 | |
| DE | 202016101311 | U1 | * | 6/2017 | ..... A01G 20/43 |
| KR | 20050012047 | A | | 1/2005 | |
| KR | 20120088314 | A | * | 8/2012 | ..... A47L 11/4094 |
| WO | WO2021020908 | A1 | | 2/2021 | |

OTHER PUBLICATIONS

International Search Report dated Apr. 26, 2022 in co-pending PCT Application No. PCT/CN2022/075553.
First Office Action dated Sep. 28, 2021 in co-pending Chinese Patent Application No. 202110186817.2.
Second Office Action dated May 24, 2022 in co-pending Chinese Patent Application No. 202110186817.2.

* cited by examiner

AUTOMATIC CLEANING DEVICE

CROSS-REFERENCE TO RELATED APPLICATION

This application is a US national phase application under 35 U.S.C. § 371 of PCT international application No. PCT/CN2022/075553 filed on Feb. 8, 2022, which claims priority to Chinese Patent Application No. 202110186817.2, filed on Feb. 10, 2021, which is incorporated herein by reference in its entirety as a part of the present application.

TECHNICAL FIELD

The present disclosure relates to the field of cleaning robot technologies, and more particularly, to an automatic cleaning apparatus.

BACKGROUND ART

At present, there are mainly two types of cleaning robots, that is, a ground sweeping robot and a ground mopping robot. The ground sweeping robot and the ground mopping robot have a single function, and may be only used for sweeping or mopping a ground. If it is desired to sweep and mop the ground at the same time, both apparatuses have to be prepared, occupying a double space and affecting the disposal of other components due to the unreasonable design of structures.

In the related art, during the working process of the sweeping and mopping integrated cleaning apparatus, since the width of the mop is often equal to the width of the bottom surface of the cleaning apparatus, while the width of the dry sweeping device is smaller than the width of the bottom surface of the cleaning apparatus, the width of the mop mopping the floor will be larger than that of sweeping, so that some ground areas are mopped before sweeping, making the ground even more unclean.

It should be noted that the information disclosed in the above background section is only for enhancing the understanding of the background of the present disclosure, and therefore may include information that does not constitute the prior art known to those of ordinary skill in the art.

SUMMARY OF THE INVENTION

An objective of the present disclosure is to provide an automatic cleaning apparatus, which can solve one of the above technical problems. The specific solutions are described below.

According to specific embodiments of the present disclosure, the present disclosure provides an automatic cleaning apparatus, including:

- a moving platform 100 configured to move automatically on an operating surface; and
- a cleaning module 150 disposed on the moving platform 100, and including:
  - a dry cleaning module 151 configured to clean at least a part of the operating surface by means of dry cleaning; and
  - a wet cleaning module 400 configured to clean at least a part of the operating surface by means of wet cleaning, where the wet cleaning module 400 includes:
    - a cleaning head 410 for cleaning the operating surface, and
    - a driving unit 420 for driving the cleaning head 410 to reciprocate along a target surface, the target surface being a part of the operating surface, where a width of a lateral cleaning area of the cleaning head 410 is smaller than a width of a lateral cleaning area of the dry cleaning module 151.

Optionally, the driving unit 420 includes:

- a driving platform 421 connected to a bottom surface of the moving platform 100 for providing a driving force; and
- a supporting platform 422 detachably connected to the driving platform 421 for supporting the cleaning head 410.

Optionally, the supporting platform 422 includes: a cleaning substrate 4221, which is freely movable on the supporting platform 422, and the cleaning substrate 4221 drives the cleaning head 410 to substantially reciprocate within the width of the lateral cleaning area.

Optionally, the cleaning substrate 4221 includes at least two first limiting positions 42212, and the at least two first limiting positions 42212 are respectively arranged on both sides of a traveling direction of the cleaning substrate 4221.

Optionally, the first limiting position 42212 is flexibly connected to the cleaning substrate 4221.

Optionally, the cleaning substrate 4221 includes at least two second limiting positions 42213, and the at least two second limiting positions 42213 are arranged on both sides of the cleaning substrate 4221 in a direction perpendicular to the traveling direction, and the at least two second limiting positions 42213 enable the cleaning head 410 to substantially reciprocate within the width of the lateral cleaning area.

Optionally, a distance between the at least two second limiting positions 42213 is smaller than the width of the lateral cleaning area.

Optionally, the at least two second limiting positions 42213 are provided with buffer pads on one side facing the cleaning substrate 4221.

Optionally, the driving platform 421 includes:

- a motor 4211 arranged on a side of the driving platform 421 close to the moving platform 100 for outputting power through a motor output shaft;
- a cam 4212 connected with the motor output shaft and having an asymmetric structure; and
- a vibrating rod 4213 arranged on a side of the driving platform 421 opposite to the motor 4211, connected with the cam 4212, and reciprocating under an asymmetrical rotation of the cam 4212.

Optionally, the cleaning substrate 4221 includes:

- an assembly notch arranged at a position in contact with the vibrating rod 4213, where when the supporting platform 422 is connected to the driving platform 421, the vibrating rod 4213 is assembled in the assembly notch, and under an action of the vibrating rod 4213, the cleaning head 410 reciprocates within the width of the lateral cleaning area.

Compared to the related art, the embodiments of the present disclosure have the following technical effects.

The present disclosure provides an automatic cleaning apparatus. The width of lateral cleaning area of the cleaning head in the wet cleaning module of the automatic cleaning apparatus is set to be smaller than the width of the lateral cleaning area of the dry cleaning module. Therefore, when the automatic cleaning apparatus is traveling, the width of the dry cleaning module located in front of the traveling route is large, while the width of the wet cleaning module located at the rear of the traveling route is small, so that there will be no wet cleaning if dust and garbage on the ground are not cleaned by the dry cleaning module, so as to avoid making the floor more dirty. At the same time, in the wet cleaning module, by adding the driving unit and the vibration region, the cleaning head can reciprocate to clean the surface to be cleaned repeatedly, so that in the motion trajectory of the cleaning robot, it can realize multiple cleaning when passing through a certain area at one time. The cleaning effect is greatly enhanced, especially for areas with more stains, the cleaning effect is obvious.

BRIEF DESCRIPTION OF THE DRAWINGS

The accompanying drawings here, which are incorporated in the Description and constitute a part of the Description, show embodiments conforming to the present disclosure, and are used to explain the principles of the present disclosure together with the Description. Apparently, the accompanying drawings in the following description are only some embodiments of the present disclosure, and for those of ordinary skills in the art, other drawings may also be obtained from these accompanying drawings without creative efforts. In the accompanying drawings.

LIST OF REFERENCE NUMERALS

Figure 1:
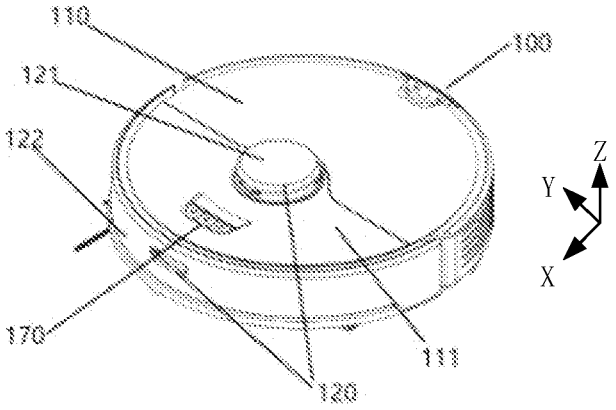
FIG. 1 is an oblique view of an automatic cleaning apparatus according to an embodiment of the present disclosure.

100—moving platform, 110—rearward portion, 111—forward portion, 120—perception system, 121—position determining device, 122—buffer, 123—cliff sensor, 130—control system, 140—driving system, 141—driving wheel assembly, 142—steering assembly, 143—elastic element, 146—driving motor, 150—cleaning module, 151—dry cleaning module, 152—dust box, 153—filter, 154—dust suction inlet, 155—air outlet, 156—blower, 160—energy system, 170—human-computer interaction system, 400—wet cleaning assembly, 410—cleaning head, 420—driving unit, 421—driving platform, 422—supporting platform, 4211—motor, 4212—driving wheel, 4213—vibrating member, 4214—connecting rod, 4215—vibration buffering device, 4216—pawl, 4218—clean water pump pipe, 4219—clean water pump, 4221—cleaning substrate, 4229—elastic detaching button, 4224—assembly region, 4225—engagement position, 4222—first sliding slot, 4223—second sliding slot, 525—first slider, 528—second slider, 512 (4227)—swiveling end, 514 (4226)—sliding end, 516 (624)—first pivot, 518 (626)—second pivot, 800 (600, 700)—driving mechanism, 500—four-link lifting and lowering structure, 501—first connecting end, 502—second connecting end, 5011—first bracket, 5012—first connecting rod pair, 50121—first connecting rod, 50122—second connecting rod, 5013—power component, 50131—motor, 42194—cable, 50131—cable motor terminal, 50132—cable bracket terminal, 50111—cross beam, 50112—sliding slot, 50113—through hole, 50114—first longitudinal beam, 50115—second longitudinal beam, 5021—second bracket, 5022—second connecting rod pair, 50221—third connecting rod, 50222—fourth connecting rod, 600—floating lifting and lowering structure, 601—first fixed bracket, 602—second fixed bracket, 603—connecting rod pair, 6031—first connecting rod pair, 6032—second connecting rod pair, 60311—first connecting rod, 60312—second connecting rod, 60321—third connecting rod, 60322—fourth connecting rod, 6011—first fixed portion, and 6012—second fixed portion.

DETAILED DESCRIPTION

To make the objectives, technical solutions and advantages of the present disclosure clearer, the present disclosure will be further described in detail below with reference to the accompanying drawings. It is obvious that the described embodiments are only some, but not all of the embodiments of the present disclosure. All other embodiments obtained by those of ordinary skills in the art without creative efforts based on the embodiments in the present disclosure are within the protection scope of the present disclosure.

The terms used in the embodiments of the present disclosure are for the purpose of describing particular embodiments only and are not intended to limit the present disclosure. The singular forms "a/an", "said" and "the" used in the embodiments of the present disclosure and the appended claims are intended to include the plural forms as well, unless otherwise indicated clearly in the context. The term "a plurality of" generally includes at least two.

It is to be understood that, the term "and/or" used herein only describes an association relationship between associated objects, and indicates that there may be three kinds of relationships. For example, A and/or B may indicate three cases: A exists alone. A and B exist at the same time, and B exists alone. In addition, the character "/" herein generally indicates an "or" relationship between the contextual objects.

It is to be understood that, although the terms first, second, third, etc. may be used to describe in the embodiments of the present disclosure, the embodiments of the present disclosure should not be limited to these terms. These terms are only used to distinguish the description. For example, "first" may also be referred to as "second" without departing from the scope of the embodiments of the present disclosure. Similarly, "second" may also be referred to as "first".

It is also to be noted that, the terms "including", "containing", or any other variants are intended to cover the nonexclusive inclusion, such that a commodity or device including a series of elements includes not only those elements, but also other elements not listed explicitly or elements inherent to such a commodity or device. Without more limitations, the element defined by the phrase "including a . . . " does not exclude the existence of other same elements in the commodity or device including the element.

Optional embodiments of the present disclosure are described in detail below with reference to the accompanying drawings.

First Embodiment

Figure 2:
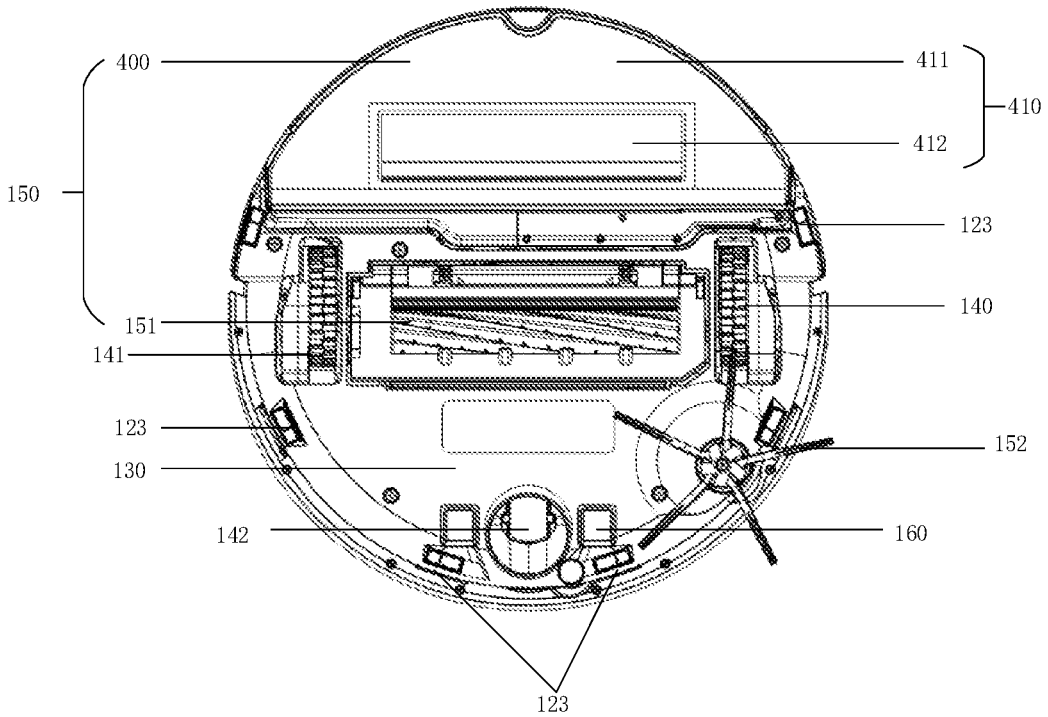
FIG. 2 is a schematic structural diagram of a bottom of an automatic cleaning apparatus according to an embodiment of the present disclosure.

FIGS. 1-2 are schematic structural diagrams of an automatic cleaning apparatus according to an exemplary embodiment. As shown in FIGS. 1-2, the automatic cleaning apparatus may be a vacuum ground sucking robot, or may be a ground mopping/brushing robot, or may be a window climbing robot, or the like. The automatic cleaning apparatus may include a moving platform 100, a perception system 120, a control system 130, a driving system 140, a cleaning module 150, an energy system 160 and a human-computer interaction system 170.

The moving platform 100 may be configured to move automatically along a target direction on an operating surface. The operating surface may be a surface to be cleaned by the automatic cleaning apparatus. In some embodiments, the automatic cleaning apparatus may be a ground mopping robot, and thus the automatic cleaning apparatus operates on a ground, and the ground is the operating surface. The automatic cleaning apparatus may also be a window cleaning robot, and thus the automatic cleaning apparatus operates on an outer surface of glass of a building, and the glass is the operating surface. The automatic cleaning apparatus may also be a pipe cleaning robot, and thus the automatic cleaning apparatus operates on an inner surface of a pipe, and the inner surface of the pipe is the operating surface. For the purpose of presentation only, the following description in the present application takes a ground mopping robot as an example for illustration.

In some embodiments, the moving platform 100 may be an autonomous moving platform, or a non-autonomous moving platform. The autonomous moving platform refers to that the moving platform 100 itself can automatically and adaptively make an operational decision based on an unexpected environmental input; and the non-autonomous moving platform itself cannot adaptively make an operational decision based on an unexpected environmental input, but can execute a given program or operate according to a certain logic. Correspondingly, when the moving platform 100 is the autonomous moving platform, the target direction may be determined autonomously by the automatic cleaning apparatus; and when the moving platform 100 is the non-autonomous moving platform, the target direction may be set systematically or manually. When the moving platform 100 is the autonomous moving platform, the moving platform 100 includes a forward portion 111 and a rearward portion 110.

The perception system 120 includes a position determining device 121 located on the moving platform 100, a buffer 122 located in the forward portion 111 of the moving platform 100, cliff sensors 123 and sensing devices such as an ultrasonic sensor (not shown), an infrared sensor (not shown), a magnetometer (not shown), an accelerometer (not shown), a gyroscope (not shown) an odometer (not shown), and the like located at a bottom of the moving platform 100, for providing various position information and motion state information of the automatic cleaning apparatus to the control system 130.

In order to describe behaviors of the automatic cleaning apparatus more clearly, directions are defined as follows: the automatic cleaning apparatus may travel on the ground by various combinations of movements relative to the following three mutually perpendicular axes defined by the moving platform 100, i.e., a transversal axis X, a front and rear axis Y and a center vertical axis Z. A forward driving direction along the front and rear axis Y is designated as "forward", and a rearward driving direction along the front and rear axis Y is designated as "rearward". The transversal axis X substantially extends between a right wheel and a left wheel of the automatic cleaning apparatus along an axis center defined by a center point of a driving wheel assembly 141. The automatic cleaning apparatus may rotate around the X axis. It is referred to as "pitch up" when the forward portion of the automatic cleaning apparatus is tilted upward and the rearward portion thereof is tilted downward, and it is referred to as "pitch down" when the forward portion of the automatic cleaning apparatus is tilted downward and the rearward portion thereof is tilted upward. In addition, the automatic cleaning apparatus may rotate around the Z axis. In a forward direction of the automatic cleaning apparatus, it is referred to as "turn right" when the automatic cleaning apparatus is tilted to the right of the Y axis, and it is referred to as "turn left" when the automatic cleaning apparatus is tilted to the left of the Y axis.

As shown in FIG. 2, cliff sensors 123 are provided at the bottom of the moving platform 100 and in front and rear of the driving wheel assembly 141, respectively, for preventing the automatic cleaning apparatus from falling off when the automatic cleaning apparatus retreats, so as to avoid a damage to the automatic cleaning apparatus. The aforementioned "front" refers to a side same as a travelling direction of the automatic cleaning apparatus, and the aforementioned "rear" refers to a side opposite to the travelling direction of the automatic cleaning apparatus.

The position determining device 121 includes, but is not limited to, a camera and a Laser Direct Structuring (LDS).

Various components in the perception system 120 may operate independently, or operate together to achieve a purpose function more accurately. The surface to be cleaned is identified by the cliff sensors 123 and the ultrasonic sensor to determine physical properties of the surface to be cleaned, including a surface material, a degree of cleanliness, and the like, and more accurate determination may be made in combination with the camera, the LDS, or the like.

For example, the ultrasonic sensor may determine whether the surface to be cleaned is a carpet. If the ultrasonic sensor determines that the surface to be cleaned is made of a carpet material, the control system 130 controls the automatic cleaning apparatus to perform cleaning in a carpet mode.

The forward portion 111 of the moving platform 100 is provided with the buffer 122. During cleaning, when the driving wheel assembly 141 propels the automatic cleaning apparatus to travel on the ground, the buffer 122 detects one or more events (or objects) in a travelling path of the automatic cleaning apparatus via a sensor system, e.g., an infrared sensor, and the automatic cleaning apparatus may control the driving wheel assembly 141 based on the event (or object), such as obstacle and wall, detected by the buffer 122 to cause the automatic cleaning apparatus to respond to the event (or object), for example, to move away from the obstacle.

The control system 130 is disposed on a main circuit board in the moving platform 100, and includes a computing processor such as a central processing unit and an application processor, that communicates with a non-transitory memory such as a hard disk, a flash memory and a random-access memory. The application processor is configured to receive environmental information sensed by the plurality of sensors and transmitted from the perception system 120, to draw a simultaneous map of an environment where the automatic cleaning apparatus is located using a positioning algorithm, e.g., simultaneous localization and mapping (SLAM), based on obstacle information fed back by the LDS, and to autonomously determine a travelling path based on the environmental information and the environmental map, and then to control the driving system 140 to perform operations, such as travelling forward, travelling backward, and/or steering based on the autonomously determined travelling path. Further, the control system 130 may also determine whether to activate the cleaning module 150 to perform a cleaning operation based on the environmental information and the environmental map.

Specifically, the control system 130 may, based on distance information and speed information which are fed back by the buffer 122, the cliff sensors 123 and the sensing devices such as the ultrasonic sensor, the infrared sensor, the magnetometer, the accelerometer, the gyroscope and the odometer, comprehensively determine a current operation state of the ground sweeping robot, such as crossing a threshold, getting on a carpet, locating at an edge of a cliff, being stuck from above or below, having a full dust box or being picked up, and will also give specific next-step action strategies for different situations, so that the operation of the automatic cleaning apparatus is more in line with requirements of an owner and provides better user experience. Further, the control system can plan the most efficient and reasonable cleaning path and cleaning mode based on the simultaneous map information drawn by the SLAM, thereby greatly improving the cleaning efficiency of the automatic cleaning apparatus.

Figure 3:
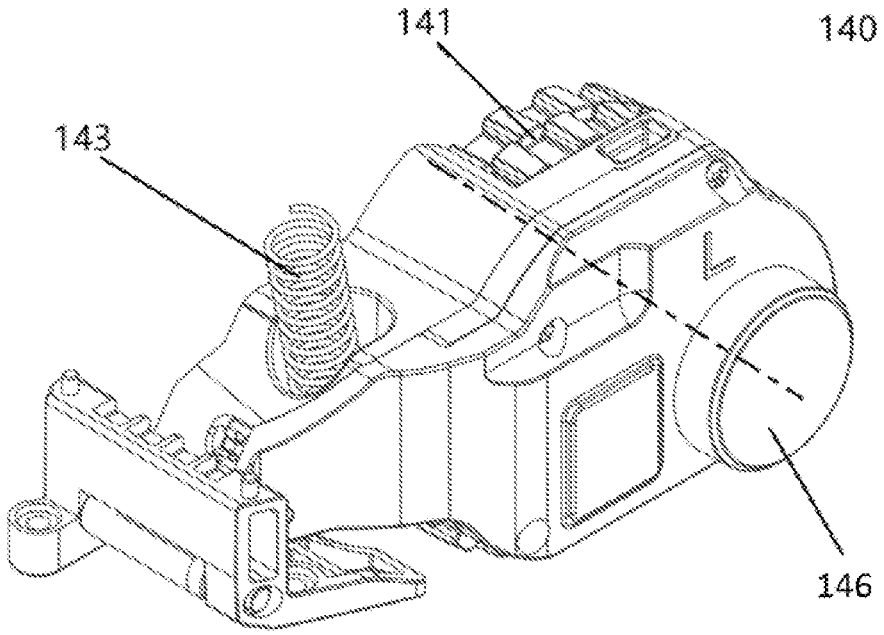
FIG. 3 is an oblique view of a driving wheel assembly on a side according to an embodiment of the present disclosure.
Figure 4:
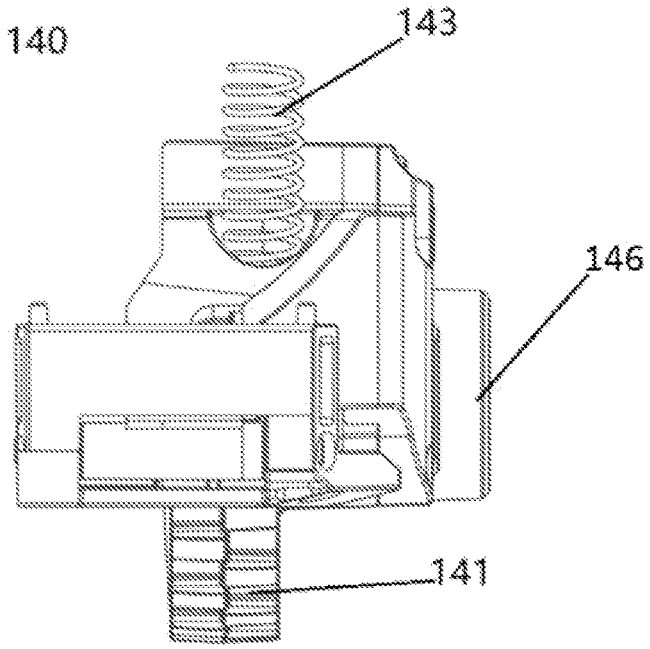
FIG. 4 is a front view of the driving wheel assembly on a side according to an embodiment of the present disclosure.

The driving system 140 may execute a driving command based on specific distance and angle information, such as x, y, and θ components, to manipulate the automatic cleaning apparatus to travel across the ground. FIG. 3 and FIG. 4 are an oblique view and a front view of a driving wheel assembly 141 on a side according to an embodiment of the present disclosure, respectively. As shown in the figures, the driving system 140 includes the driving wheel assembly 141, and may control a left wheel and a right wheel simultaneously. In order to control the motion of the automatic cleaning apparatus more precisely, the driving system 140 preferably includes a left driving wheel assembly and a right driving wheel assembly. The left driving wheel assembly and the right driving wheel assembly are arranged symmetrically along a transversal axis defined by the moving platform 100. The driving wheel assembly includes a body portion, a driving wheel and an elastic element. One end of the body portion is connected to a frame; the driving wheel is disposed in the body portion and driven by a driving motor 146; and the elastic element is connected between the body portion and the frame, and configured to provide an elastic force between the frame and the body portion. The driving motor 146 is located outside the driving wheel assembly 141, an axis center of the driving motor 146 is located within a sectional projection of the driving wheel, and the driving wheel assembly 141 may also be connected to a circuit for measuring a driving current and the odometer.

In order for the automatic cleaning apparatus to move on the ground more stably or have stronger movement ability, the automatic cleaning apparatus may include one or more steering assemblies 142, where the steering assembly 142 may be a driven wheel or a driving wheel, and its structural form includes but is not limited to a universal wheel. The steering assembly 142 may be located in front of the driving wheel assembly 141.

The driving motor 146 provides power for rotation of the driving wheel assembly 141 and/or the steering assembly 142.

The driving wheel assembly 141 may be detachably connected to the moving platform 100 to facilitate assembly, disassembly and maintenance. The driving wheel may have an offset drop suspension system movably fastened. e.g., rotatably attached, to the moving platform 100 of the automatic cleaning apparatus, and maintain contact and traction with the ground by an elastic element 143 such as a tension spring or a compression spring with a certain grounding force; meanwhile, the cleaning module 150 of the automatic cleaning apparatus is also in contact with the surface to be cleaned with a certain pressure.

The energy system 160 includes a rechargeable battery, such as a nickel-hydride battery and a lithium battery. The rechargeable battery may be connected with a charging control circuit, a battery pack charging temperature detecting circuit and a battery undervoltage monitoring circuit, where the charging control circuit, the battery pack charging temperature detecting circuit and the battery undervoltage monitoring circuit are then connected to a single-chip microcomputer control circuit. A host is connected to a charging pile through a charging electrode disposed on a side of or below a body of the host for charging.

The human-computer interaction system 170 includes buttons that are on a panel of the host and used by a user to select functions. The human-computer interaction system 170 may further include a display screen and/or an indicator light and/or a horn that present a current state or function selection items of the automatic cleaning apparatus to the user. The human-computer interaction system 170 may further include a mobile client program. For a route navigation type cleaning apparatus, a mobile client may present a map of the environment where the apparatus is located and a position of the apparatus to the user, which can provide relatively rich and user-friendly function items to the user.

The cleaning module 150 may include a dry cleaning module 151 and/or a wet cleaning module 400.

As shown in FIGS. 5-8, the dry cleaning module 151 includes a rolling brush, a dust box, a blower and an air outlet. The rolling brush having a certain interference with the ground sweeps up garbage on the ground and rolls up the garbage to the front of a dust suction inlet between the rolling brush and the dust box, and then the garbage is sucked into the dust box by air having a suction force, which is generated by the blower and passes through the dust box. A dust removal capacity of the ground sweeping robot may be characterized by a dust pickup efficiency (DPU) of the garbage. The DPU is affected by a structure and material of the rolling brush, by a utilization rate of the air in an air channel formed by the dust suction inlet, the dust box, the blower, the air outlet and connecting components between the four, and by a type and power of the blower, which is a complex systematic design problem. Compared with an ordinary plug-in vacuum cleaner, the improvement of the dust removal capacity is more meaningful for an automatic cleaning apparatus with limited energy because the improvement of the dust removal capacity directly and effectively reduces requirements for energy, that is, the original cleaning apparatus that may clean 80 square meters of the ground on a single charge may be evolved to clean 180 square meters or more on a single charge. Furthermore, the service life of the battery with the reduced number of charging times will also be greatly increased, so that the frequency of replacing the battery by the user will also be decreased. More intuitively and importantly, the improvement of the dust removal capacity is the most obvious and important user experience, and the user will directly determine whether the thorough cleaning is achieved. The dry cleaning module may further include a side brush 152 having a rotary shaft angled relative to the ground, for moving debris into a region of the rolling brush of the cleaning module 150.

Figure 5:
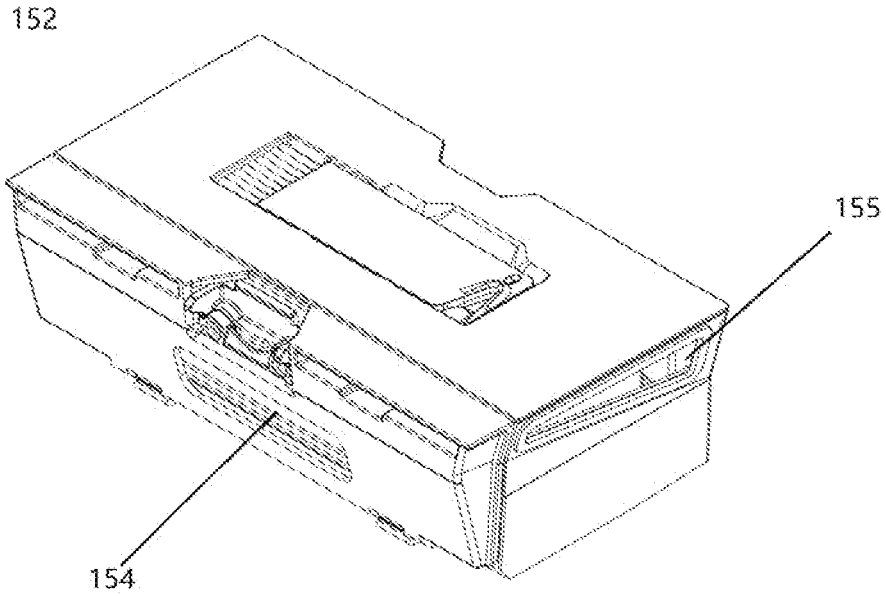
FIG. 5 is an oblique view of a dust box according to an embodiment of the present disclosure.
Figure 6:
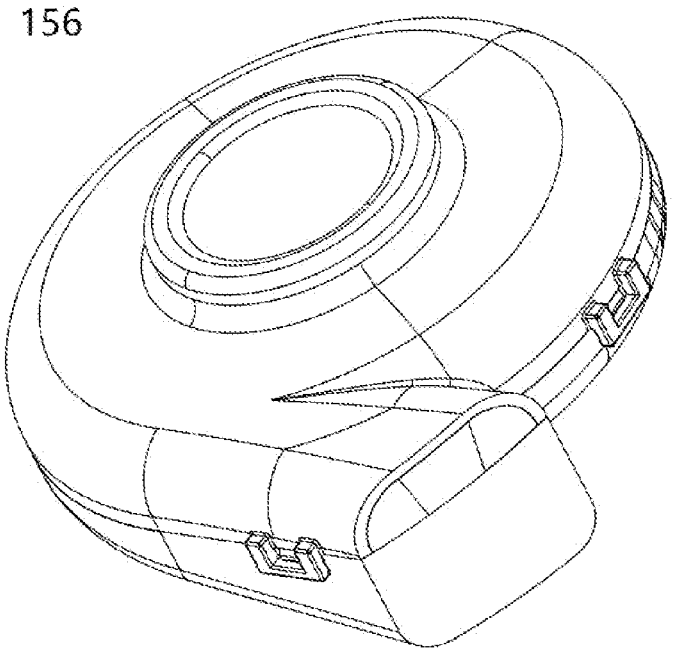
FIG. 6 is an oblique view of a blower according to an embodiment of the present disclosure.
Figure 7:
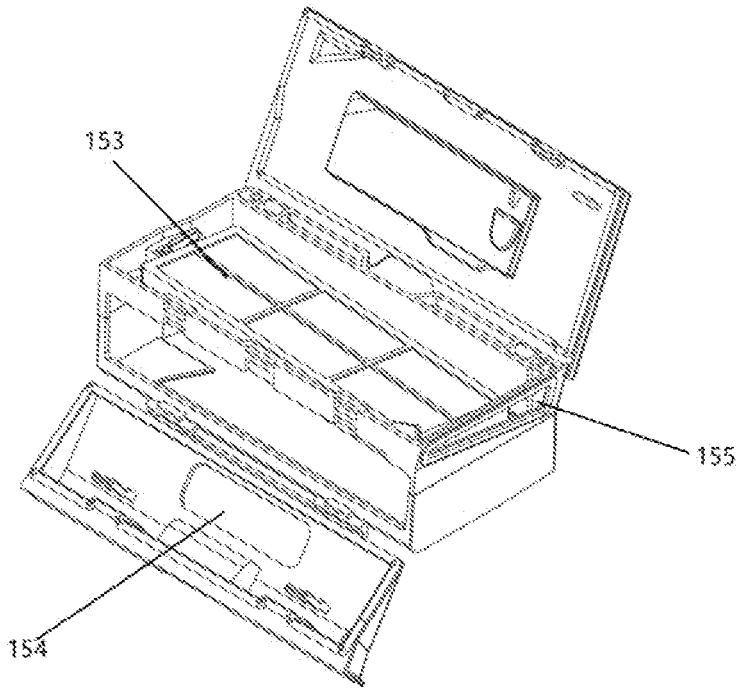
FIG. 7 is a schematic diagram of a dust box in an open state according to an embodiment of the present disclosure.
Figure 8:
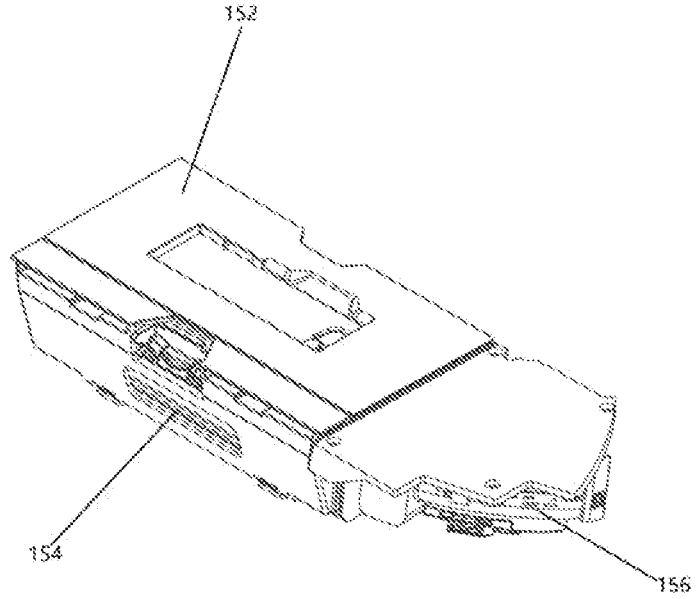
FIG. 8 is a schematic diagram of a dust box and a blower in an assembled state according to an embodiment of the present disclosure.

FIG. 5 is a schematic structural diagram of a dust box 152 in the dry cleaning module, FIG. 6 is a schematic structural diagram of a blower 156 in the dry cleaning module, FIG. 7 is a schematic diagram of the dust box 152 in an open state, and FIG. 8 is a schematic diagram of the dust box and the blower in an assembled state.

The rolling brush having a certain interference with the ground sweeps up garbage on the ground and rolls up the garbage to the front of the dust suction inlet 154 between the rolling brush and the dust box 152, and then the garbage is sucked into the dust box 152 by air having a suction force, which is generated by the blower 156 and passes through the dust box 152. The garbage is isolated inside the dust box 152 close to the dust suction inlet 154 by a filter 153, and the filter 153 completely isolates the dust suction inlet from the air outlet, so that the filtered air enters the blower 156 through the air outlet 155.

Typically, the dust suction inlet 154 of the dust box 152 is located in front of the automatic cleaning apparatus, the air outlet 155 is located on a side of the dust box 152, and an air inlet of the blower 156 is docked with the air outlet of the dust box.

A front panel of the dust box 152 may be opened for cleaning the garbage in the dust box 152.

The filter 153 is detachably connected to a body of the dust box 152 to facilitate assembling, disassembling and cleaning the filter.

Figure 9:
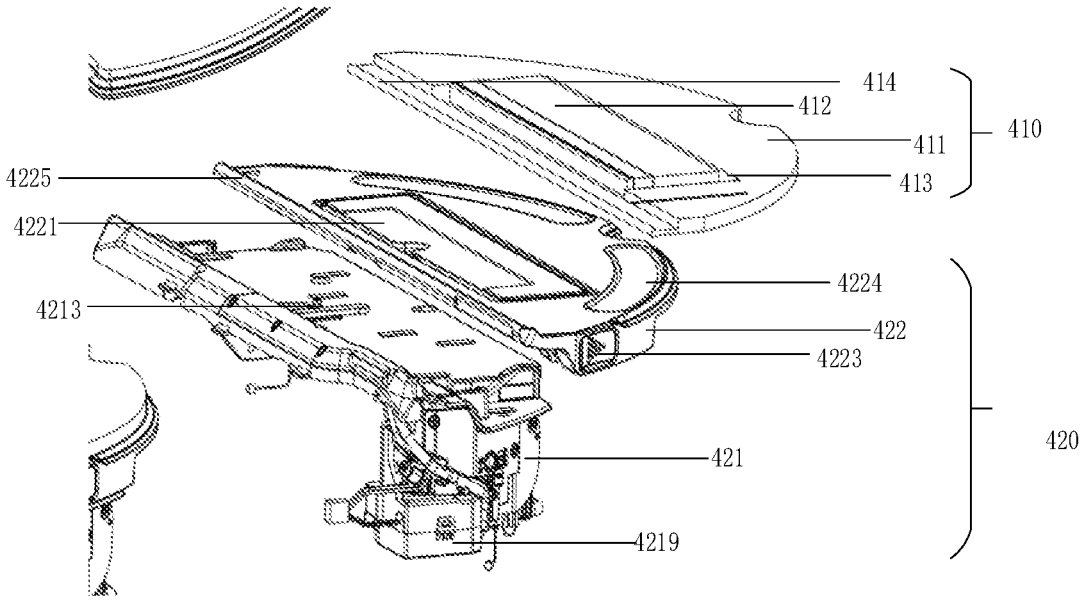
FIG. 9 is an exploded view of an automatic cleaning apparatus according to an embodiment of the present disclosure.
Figure 10:
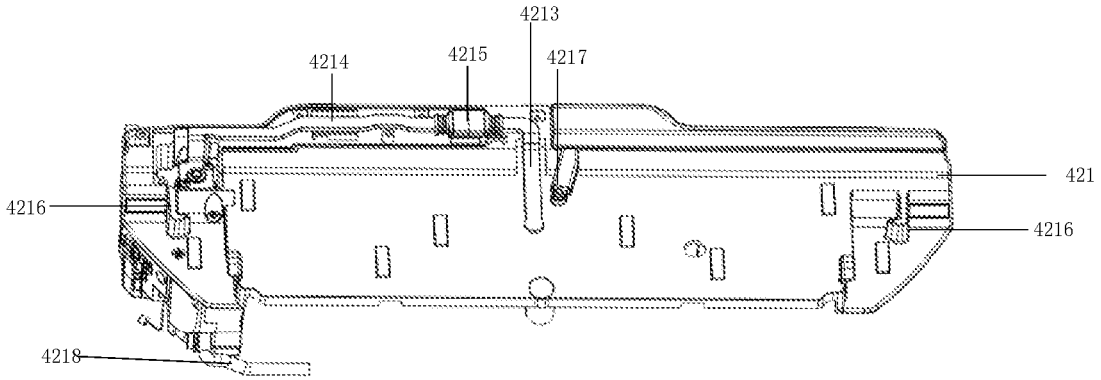
FIG. 10 is a structural diagram of a supporting platform of an automatic cleaning apparatus according to an embodiment of the present disclosure.
Figure 11:
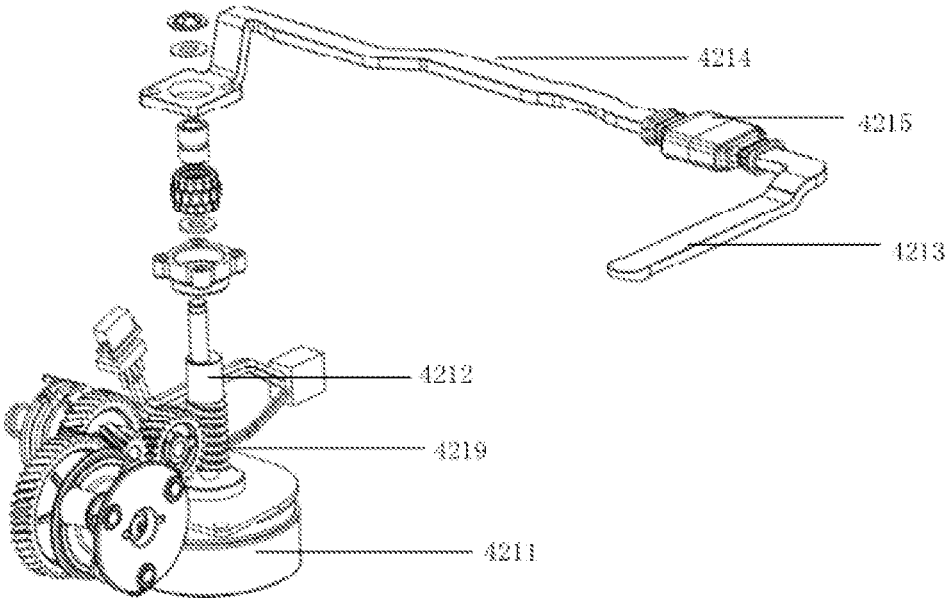
FIG. 11 is a structural diagram of a vibrating member of an automatic cleaning apparatus according to an embodiment of the present disclosure.

According to a specific embodiment of the present disclosure, as shown in FIGS. 9-11, the wet cleaning module 400 according to the present disclosure is configured to clean at least a part of the operating surface by means of wet cleaning. The wet cleaning module 400 includes a cleaning head 410 and a driving unit 420. The cleaning head 410 is used for cleaning at least a part of the operating surface, and the driving unit 420 is used for driving the cleaning head 410 to substantially reciprocate along a target surface, the target surface being a part of the operating surface. The cleaning head 410 reciprocates along a surface to be cleaned, and a surface of the cleaning head 410 in contact with the surface to be cleaned is provided with a cleaning cloth or a cleaning plate, which generates a high-frequency friction with the surface to be cleaned through reciprocating motion, thereby removing stains on the surface to be cleaned.

The higher the friction frequency is, the more friction times per unit time is. A high-frequency reciprocating motion, also referred to as reciprocating vibration, has a much higher cleaning ability than an ordinary reciprocating motion, e.g., rotational friction cleaning. Optionally, when the friction frequency approaches a sound wave, a cleaning effect will be much higher than that of the rotational friction cleaning of dozens of revolutions per minute. On the other hand, tufts on the surface of the cleaning head are more uniform and extend in the same direction under the shaking of high-frequency vibration so as to achieve a more uniform overall cleaning effect, rather than being only applied with a down pressure to increase the frictional force in the case of low-frequency rotation so as to improve the cleaning effect, as only the down pressure does not cause the tufts to extend in the nearly same direction. Therefore, in terms of the effect, water marks on the operating surface cleaned under the high-frequency vibration are more uniform without chaotic water stains.

The reciprocating motion may be a repeated motion along any one or more directions within the operating surface, or may be a vibrating motion perpendicular to the operating surface, which is not strictly limited. Optionally, the direction of the reciprocating motion of the cleaning module is substantially perpendicular to the travelling direction of the automatic cleaning apparatus because the direction of the reciprocating motion being parallel to the travelling direction of the automatic cleaning apparatus may cause the automatic cleaning apparatus itself, which is travelling, to be unstable for the reason that thrust and resistance in the travelling direction make it easy for the driving wheel to skid, and the effect of skid is more obvious when the wet cleaning module is included, as the wetness of the operating surface increases the possibility of skid. The skid not only affects the stable travelling of the automatic cleaning apparatus for cleaning, but also causes the sensors such as the odometer and the gyroscope to measure a distance inaccurately, thereby resulting in the inability of the navigation type automatic cleaning apparatus to locate and draw a map accurately. In the case of frequent skid, the effect on the SLAM cannot be ignored. Therefore, it is necessary to avoid the skid of the automatic cleaning apparatus as much as possible. In addition to skid, a motion component of the cleaning head in the travelling direction of the automatic cleaning apparatus causes the automatic cleaning apparatus to be pushed forward and backward constantly during travelling, so the automatic cleaning apparatus cannot travel stably and smoothly.

As an optional embodiment of the present disclosure, as shown in FIG. 9, the driving unit 420 includes: a driving platform 421 connected to a bottom surface of the moving platform 100 for providing a driving force; and a supporting platform 422 detachably connected to the driving platform 421, for supporting the cleaning head 410 and being able to lift and lower under the driving of the driving platform 421.

As an optional embodiment of the present disclosure, a lifting and lowering module is provided between the cleaning module 150 and the moving platform 100, so that the cleaning module 150 may be in better contact with the surface to be cleaned, or different cleaning strategies may be used for surfaces to be cleaned made of different materials.

Optionally, the dry cleaning module 151 may be connected to the moving platform 100 by a passive lifting and lowering module. When the cleaning apparatus encounters an obstacle, the dry cleaning module 151 may pass the obstacle more easily through the lifting and lowering module.

Optionally, the wet cleaning module 400 may be connected to the moving platform 100 by an active lifting and lowering module. When the wet cleaning module 400 does not participate in the operation temporarily, or when a surface to be cleaned cannot be cleaned by the wet cleaning module 400, the wet cleaning module 400 is lifted by the active lifting and lowering module and separated from the surface to be cleaned, so as to realize the change of cleaning means.

As shown in FIGS. 10-11, the driving platform 421 includes: a motor 4211 disposed on a side of the driving platform 421 close to the moving platform 100 and for outputting power through a motor output shaft; a driving wheel 4212 connected to the motor output shaft and having an asymmetric structure; and a vibrating member 4213 disposed on a side of the driving platform 421 opposite to the motor 4211 and connected to the driving wheel 4212 to reciprocate under the asymmetrical rotation of the driving wheel 4212.

The driving platform 421 may further include a gear mechanism. The gear mechanism may connect the motor 4211 and the driving wheel 4212. The motor 4211 may directly drive the driving wheel 4212 to swivel, or may indirectly drive the driving wheel 4212 to swivel through the gear mechanism. Those of ordinary skills in the art may understand that the gear mechanism may be one gear, or may be a gear set composed of a plurality of gears.

The motor 4211 simultaneously transmits, through a power transmission device, power to the cleaning head 410, the driving platform 421, the supporting platform 422, a water delivery mechanism, a water tank, and the like. The energy system 160 provides power and energy for the motor 4211 and is entirely controlled by the control system 130. The power transmission device may be a gear drive, a chain drive, a belt drive, or may be a worm gear, or the like.

The motor 4211 has a forward output mode and a reverse output mode. In the forward output mode, the motor 4211 rotates in the forward direction; and in the reverse output mode, the motor 4211 rotates in the reverse direction. In the forward output mode of the motor 4211, the motor 4211 simultaneously drives, through the power transmission device, the vibrating member 4213 of the driving platform in the wet cleaning assembly 400 to substantially reciprocate and the water delivery mechanism to move synchronously. In the reverse output mode of the motor 4211, the motor 4211 drives the driving platform 421 to lift and lower through the power transmission device.

Further, the driving platform 421 further includes a connecting rod 4214 extending along an edge of the driving platform 421 and connecting the driving wheel 4212 and the vibrating member 4213, so that the vibrating member 4213 extends to a preset position. An extension direction of the vibrating member 4213 is perpendicular to the connecting rod 4214, so that a reciprocating motion direction of the vibrating member 4213 is substantially perpendicular to the travelling direction of the automatic cleaning apparatus.

Figure 15:
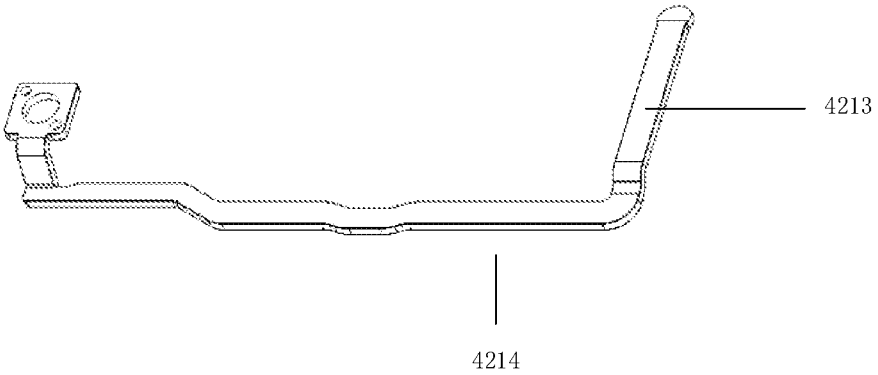
FIG. 15 is a structural diagram of a vibrating member according to an embodiment of the present disclosure.

The motor 4211 is connected to the driving wheel 4212, the vibrating member 4213, the connecting rod 4214 and a vibration buffering device 4215 through the power transmission device. The vibrating member 4213 and the connecting rod 4214 constitute an approximate L-shaped structure, as shown in FIG. 15. The vibrating member 4213 reciprocates under the driving of the connecting rod 4214. The vibration buffering device 4215 has functions of damping and reducing the shaking of a motion behavior driven by the driving wheel 4212, so that the vibrating member 4213 may vibrate stably within a range of motion provided by the supporting platform 422. Optionally, the vibration buffering device 4215 is made of a soft material, optionally a rubber structure, and the vibration buffering device 4215 is sleeved on the connecting rod 4214. On the other hand, the vibration buffering device 4215 may also protect the vibrating member 4213 from being damaged due to the collision with the driving platform 421, and thus may also affect the reciprocating motion of the vibrating member 4213. Movable components and fixed components of the driving platform 421 are restricted from moving in the travelling direction of the automatic cleaning apparatus through connections with less elasticity, and are connected flexibly and allowed to move in the direction substantially perpendicular to the travelling direction, that is, in a vibration direction of the vibrating member 4213. The above two movement restrictions cause the vibrating member 4213 to substantially reciprocate rather than accurately reciprocate. When the wet cleaning assembly 400 is activated, the motor 4211 is started to rotate forward to drive the connecting rod 4214 through the driving wheel 4212 to reciprocate along the surface of the driving platform 421; meanwhile, the vibration buffering device 4215 drives the vibrating member 4213 to substantially reciprocate along the surface of the driving platform 421, the vibrating member 4213 drives a cleaning substrate 4221 to substantially reciprocate along the surface of the supporting platform 422, and the cleaning substrate 4221 drives a movable region 412 to substantially reciprocate along the surface to be cleaned. At this time, a clean water pump enables clean water to flow out of a clean water tank and sprinkles the clean water on the cleaning head 410 through a water discharging device 4217, and the cleaning head 410 cleans the surface to be cleaned by the reciprocating motion.

The cleaning intensity/efficiency of the automatic cleaning apparatus may also be automatically and dynamically adjusted according to an operation environment of the automatic cleaning apparatus. For example, the automatic cleaning apparatus may achieve dynamic adjustment according to physical information of the surface to be cleaned detected by the perception system 120. For example, the perception system 120 may detect the flatness of the surface to be cleaned, a material of the surface to be cleaned, the existence of oil and dust, and other information, and transmit the information to the control system 130 of the automatic cleaning apparatus. Correspondingly, the control system 130 may instruct the automatic cleaning apparatus to automatically and dynamically adjust a rotational speed of the motor and a transmission ratio of the power transmission device according to the operation environment of the automatic cleaning apparatus, so as to adjust a preset reciprocating period of the reciprocating motion of the cleaning head 410.

For example, when the automatic cleaning apparatus operates on a flat ground, the preset reciprocating period may be automatically and dynamically adjusted to be longer, and a water volume of the water pump may be automatically and dynamically adjusted to be smaller; and when the automatic cleaning apparatus operates on a less flat ground, the preset reciprocating period may be automatically and dynamically adjusted to be shorter, and the water volume of the water pump may be automatically and dynamically adjusted to be larger. This is because it is easier to clean the flat ground than the less flat ground, and thus the reciprocating motion of the cleaning head 410 at a higher speed (i.e., a higher frequency) and the larger water volume are needed for cleaning an uneven ground.

For another example, when the automatic cleaning apparatus operates on a table, the preset reciprocating period may be automatically and dynamically adjusted to be longer, and the water volume of the water pump may be automatically and dynamically adjusted to be smaller; and when the automatic cleaning apparatus 100 operates on a ground, the preset reciprocating period may be automatically and dynamically adjusted to be shorter, and the water volume of the water pump may be automatically and dynamically adjusted to be larger. This is because the table has less dust and oil compared to the ground, the material of the table is also easier to be cleaned, and thus, the table can be cleaned with the fewer number of reciprocating motions of the cleaning head 410 and the relatively small water volume of the water pump.

Figure 16:
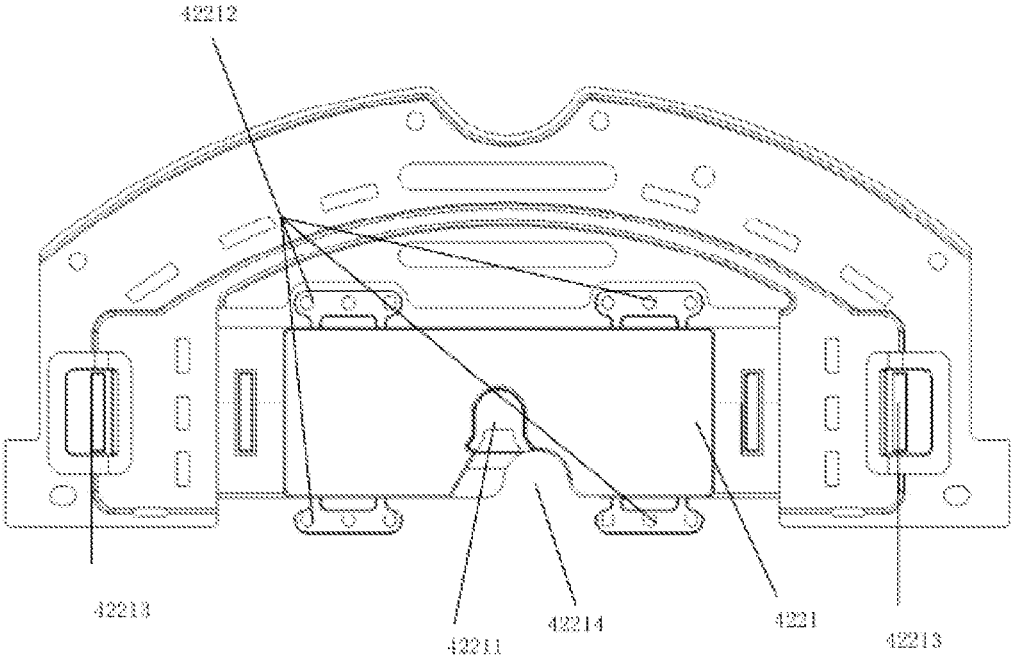
FIG. 16 is a schematic structural diagram of the assembly of a cleaning substrate according to an embodiment of the present disclosure.

As an optional embodiment of the present disclosure, the supporting platform 422 includes a cleaning substrate 4221 movably disposed on the supporting platform 422 and substantially reciprocating under the vibration of the vibrating member 4213. Optionally, as shown in FIG. 16, the cleaning substrate 4221 includes an assembly notch 42211 disposed at a position in contact with the vibrating member 4213. When the supporting platform 422 is connected to the driving platform 421, the vibrating member 4213 is assembled to the assembly notch 42211, so that the cleaning substrate 4221 may substantially reciprocate synchronously along with the vibrating member 4213. The cleaning substrate 4221 includes four first limiting positions 42212 in the travelling direction of the cleaning apparatus, and the four first limiting positions 42212 are flexibly connected to the cleaning substrate 4221 with a small elastic scaling space, thereby limiting the movement of the cleaning substrate 4221 in the travelling direction of the cleaning apparatus relative to the supporting platform 422. The cleaning substrate 4221 includes two second limiting portions 42213 in a direction perpendicular to the travelling direction of the cleaning apparatus, and the two second limiting positions 42213 limit a range of the reciprocating motion of the cleaning substrate 4221 in the direction perpendicular to the travelling direction of the cleaning apparatus. Furthermore, a water discharging hole 42214 is provided near the assembly notch 42211 of the cleaning substrate 4221 to enable water to flow from the water discharging device 4217 to the cleaning head 410 via the water discharging hole. The cleaning substrate 4221 substantially reciprocates due to the influence of the limiting positions and the vibration buffering device. The cleaning substrate 4221 is located in a portion of the supporting platform 422, and the vibration frequency may be made relatively high by means of local vibration, such as reaching a frequency range of the sound wave. The movable components and the fixed components of the driving platform 421 are restricted from moving in the travelling direction of the automatic cleaning apparatus through connections with less elasticity, and are connected flexibly and allowed to move in the direction substantially perpendicular to the travelling direction, that is, in the vibration direction of the vibrating member 4213.

Figure 12:
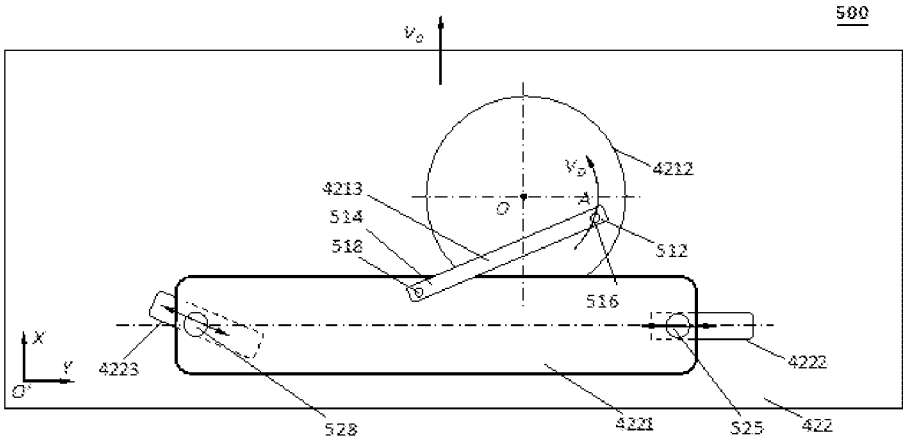
FIG. 12 is a schematic diagram of a cleaning head driving mechanism based on a crank slider mechanism according to another embodiment of the present disclosure.

FIG. 12 shows another cleaning head driving mechanism 500 based on a crank slider mechanism according to a plurality of embodiments of the present application. The driving mechanism 500 may be applied to the driving platform 421. The driving mechanism 500 includes a driving wheel 4212, a vibrating member 4213, a cleaning substrate 4221, a sliding slot 4222 (a first sliding slot) and a sliding slot 4223 (a second sliding slot).

The sliding slots 4222 and 4223 are formed in the supporting platform 422. Both ends of the cleaning substrate 4221 include a slider 525 (a first slider) and a slider 528 (a second slider), respectively. Each of the sliders 525 and 528 is a protrusion at each of both ends of the cleaning substrate 4221. The slider 525 is inserted into the sliding slot 4222 and may slide along the sliding slot 4222, and the slider 528 is inserted into the sliding slot 4223 and may slide along the sliding slot 4223. In some embodiments, the sliding slot 4222 and the sliding slot 4223 are on the same straight line. In some embodiments, the sliding slot 4222 and the sliding slot 4223 are not on the same straight line. In some embodiments, the sliding slot 4222 and the sliding slot 4223 extend along the same direction. In some embodiments, the extension direction of the sliding slot 4222 and the sliding slot 4223 is the same as that of the cleaning substrate 4221. In some embodiments, the extension direction of the sliding slot 4222 and the sliding slot 4223 is different from that of the cleaning substrate 4221. In some embodiments, the extension direction of the sliding slot 4222 is different from that of the sliding slot 4223. For example, as shown in FIG. 12, the extension direction of the sliding slot 4222 is the same as that of the cleaning substrate 4221, and the extension direction of the sliding slot 4223 is at a certain angle with that of the sliding slot 4222.

The vibrating member 4213 includes a swiveling end 512 and a sliding end 514. The swiveling end 512 is connected to the driving wheel 4212 through a first pivot 516, and the sliding end 514 is connected to the cleaning substrate 4221 through a second pivot 518.

A swiveling center of the driving wheel 4212 is a point O, and a pivoting center of the first pivot 516 is a point A. The point O and the point A do not coincide, and the distance between the point O and the point A is a preset distance d.

When the driving wheel 4212 rotates, the point A also swivels along a circular path. Correspondingly, the swiveling end 512 follows the point A to swivel along the circular path, and the sliding end 514 drives the cleaning substrate 4221 to slide through the second pivot 518. Correspondingly, the slider 525 of the cleaning substrate 4221 linearly reciprocates along the sliding slot 4222, and the slider 528 linearly reciprocates along the sliding slot 4223. In FIG. 4, a moving speed of the moving platform 210 is V0, and a moving direction thereof is a target direction. According to some embodiments, when the sliding slot 4223 and the sliding slot 4222 are approximately perpendicular to the direction of the moving speed V0 of the moving platform 210 respectively, an overall displacement of the cleaning substrate 4221 is substantially perpendicular to the target direction. According to some other embodiments, when any one of the sliding slot 4223 and the sliding slot 4222 forms an angle other than 90 degrees with the target direction, the overall displacement of the cleaning substrate 4221 includes both a component perpendicular to the target direction and a component parallel to the target direction.

Further, a vibration buffering device 4215 is included, which is disposed on the connecting rod 4214 for reducing vibration in a specific direction. In this embodiment, the vibration buffering device 4215 is used for reducing the vibration in a direction of a movement component perpendicular to the target direction of the automatic cleaning apparatus.

Figure 13:
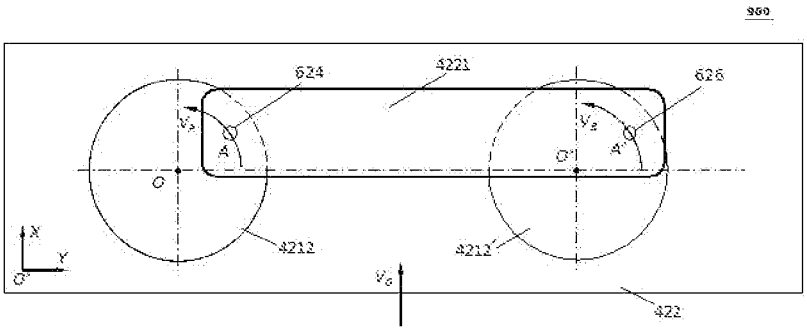
FIG. 13 is a schematic diagram of a cleaning head driving mechanism based on a double-crank mechanism according to another embodiment of the present disclosure.

FIG. 13 shows another cleaning head driving mechanism 600 based on a double-crank mechanism according to a plurality of embodiments of the present application. The driving mechanism 600 may be applied to the driving platform 421. The driving mechanism 600 includes a driving wheel 4212 (a first driving wheel), a driving wheel 4212' (a second driving wheel) and a cleaning substrate 4221.

The cleaning substrate 4221 has two ends, a first end thereof is connected to the driving wheel 4212 through a pivot 624 (a first pivot), and a second end thereof is connected to the driving wheel 4212' through a pivot 626 (a second pivot). A swiveling center of the driving wheel 4212 is a point O, and a pivoting center of the pivot 624 is a point A. The point O and the point A do not coincide, and the distance between the point O and the point A is a preset distance d. A swiveling center of the driving wheel 236 is a point O', and a pivoting center of the pivot 626 is point A'. The point O' and the point A' do not coincide, and the distance between the point O' and the point A' is a preset distance d. In some embodiments, the point A, the point A', the point O, and the point O' are located on the same plane. Therefore, the driving wheel 4212, the driving wheel 4212' and the cleaning substrate 4221 may form a double-crank mechanism (or a parallelogram mechanism), where the cleaning substrate 4221 acts as a coupling lever, and the driving wheels 4212 and 4212' act as two cranks.

Further, a vibration buffering device 4215 is included, which is disposed on the connecting rod 4214 for reducing vibration in a specific direction. In this embodiment, the vibration buffering device 4215 is used for reducing the vibration in a direction of a movement component perpendicular to the target direction of the automatic cleaning apparatus.

Figure 14:
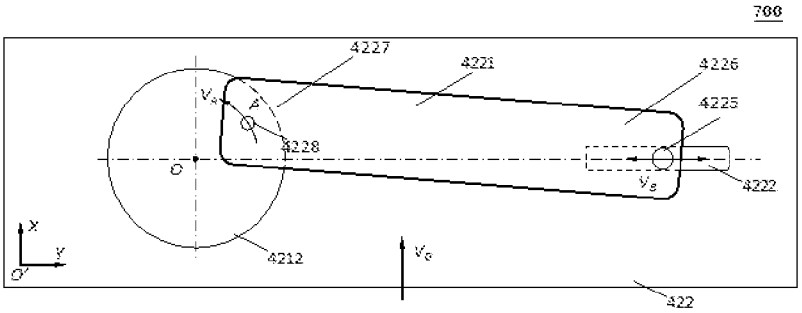
FIG. 14 is a schematic diagram of a cleaning head driving mechanism based on a crank mechanism according to another embodiment of the present disclosure.

FIG. 14 shows a driving mechanism 700 based on a crank slider mechanism according to a plurality of embodiments of the present application. The driving mechanism 700 may be applied to the driving platform 421. The driving mechanism 700 includes a driving wheel 4212, a cleaning substrate 4221 and a sliding slot 4222.

The sliding slot 4222 is formed in the supporting platform 422. The cleaning substrate 4221 includes a swiveling end 4227 and a sliding end 4226. The swiveling end 4227 is connected to the driving wheel 4212 through a pivot 4228. A swiveling center of the driving wheel 4212 is a point O, and a pivoting center of the pivot 4228 of the swiveling end is a point A. The point O and the point A do not coincide, and the distance between the point O and the point A is a preset distance d. The sliding end 4226 includes a slider 4225. The slider 4225 is a protrusion on the sliding end 4226. The slider 4225 is inserted into the sliding slot 4222 and may slide along the sliding slot 4222. Therefore, the driving wheel 4212, the cleaning substrate 4221, the slider 4225 and the sliding slot 4222 constitute the crank slider mechanism.

When the driving wheel 4212 rotates, the point A swivels along a circular path. Correspondingly, the swiveling end 4227 of the cleaning substrate 4221 follows the point A to swivel along the circular path, and the slider 4225 also slides in the sliding slot 4222 and reciprocates linearly. As a result, the cleaning substrate 4221 starts to reciprocate. According to some embodiments, an extending direction of the sliding slot 4222 is approximately perpendicular to the target direction in which the moving platform moves. Therefore, the linear motion of the sliding end 4226 includes a component perpendicular to the target direction, and the circular swiveling motion of the swiveling end 4227 includes both a component perpendicular to the target direction and a component parallel to the target direction.

In FIG. 14, a moving speed of the moving platform is V0, and a moving direction thereof is a target direction, and the sliding slot 4222 is approximately perpendicular to the target direction. At this time, the reciprocating motion of the cleaning substrate 4221 as a whole includes both a movement component parallel to the target direction of the automatic cleaning apparatus and a movement component perpendicular to the target direction of the automatic cleaning apparatus.

Further, the supporting platform 422 further includes an elastic detaching button 4229 disposed on at least one side of the supporting platform 422 for detachably connecting the supporting platform 422 to pawls 4216 of the driving platform 421, so that the supporting platform 422 is detachably and mechanically fixed on the driving platform 421, and fixed relative to the driving platform and the automatic cleaning apparatus. At least one assembly region 4224 is disposed on the supporting platform 422 for assembling the cleaning head 410. The assembly region 4224 may be formed of an adhesive material with an adhesive layer.

As an optional embodiment of the present disclosure, as shown in FIG. 9, the cleaning head 410 includes a movable region 412 connected to the cleaning substrate 4221 to substantially reciprocate along the surface to be cleaned under the driving of the cleaning substrate 4221. The movable region 412 is disposed at a substantially central position of the cleaning head 410.

Optionally, an adhesive layer is provided on a side of the movable region 412 connected to the cleaning substrate 4221, and the movable region 412 is connected to the cleaning substrate 4221 through the adhesive layer.

Optionally, the cleaning head 410 further includes a fixed region 411 connected to a bottom of the supporting platform 422 through the at least one assembly region 4224. The fixed region 411 cleans at least a part of the operating surface along with the movement of the supporting platform 422.

Further, the cleaning head 410 further includes a flexible connecting portion 413 disposed between the fixed region 411 and the movable region 412 for connecting the fixed region 411 and the movable region 412. The cleaning head 410 further includes a sliding fastener 414 extending along an edge of the cleaning head 410 and detachably mounted at an engagement position 4225 of the supporting platform 422.

In this embodiment, as shown in FIG. 9, the cleaning head 410 may be made of a material with certain elasticity, and is fixed to the surface of the supporting platform 422 through the adhesive layer so as to achieve reciprocating motion. The cleaning head 410 is always in contact with the surface to be cleaned during operation.

The water delivery mechanism includes a water discharging device 4217 that may be directly or indirectly connected to a cleaning liquid outlet of a water tank (not shown), that is, a liquid outlet of the clean water tank. The cleaning liquid may flow to the water discharging device 4217 via the cleaning liquid outlet of the water tank, and may be evenly coated on the surface to be cleaned through the water discharging device. A connecting member (not shown) may be provided on the water discharging device, and the water discharging device is connected to the cleaning liquid outlet of the water tank through the connecting member. The water discharging device is provided with a distribution port which may be a continuous opening or a combination of several discontinuous small openings, and several nozzles may be provided at the distribution port. The cleaning liquid flows to the distribution port via the cleaning liquid outlet of the water tank and the connecting member of the water discharging device, and is evenly coated on the operating surface via the distribution port.

The water delivery mechanism may further include a clean water pump 4219 and/or a clean water pump pipe 4218. The clean water pump 4219 may be communicated with the cleaning liquid outlet of the water tank directly, or communicated with the cleaning liquid outlet of the water tank through the clean water pump pipe 4218.

The clean water pump 4219 may be connected to the connecting member of the water discharging device, and configured to pump the cleaning liquid from the water tank to the water discharging device. The clean water pump may be a gear pump, a vane pump, a plunger pump, a peristaltic pump, or the like.

The water delivery mechanism draws the cleaning liquid out of the clean water tank through the clean water pump 4219 and the clean water pump pipe 4218, and transports the cleaning liquid to the water discharging device. The water discharging device 4217 may be a sprinkler head, a drip hole, a wet cloth, or the like, and may uniformly spread water on the cleaning head so as to wet the cleaning head and the surface to be cleaned. Stains on the wetted surface to be cleaned can be cleaned more easily. In the wet cleaning assembly 400, the power/flow rate of the clean water pump may be adjusted.

Figure 17:
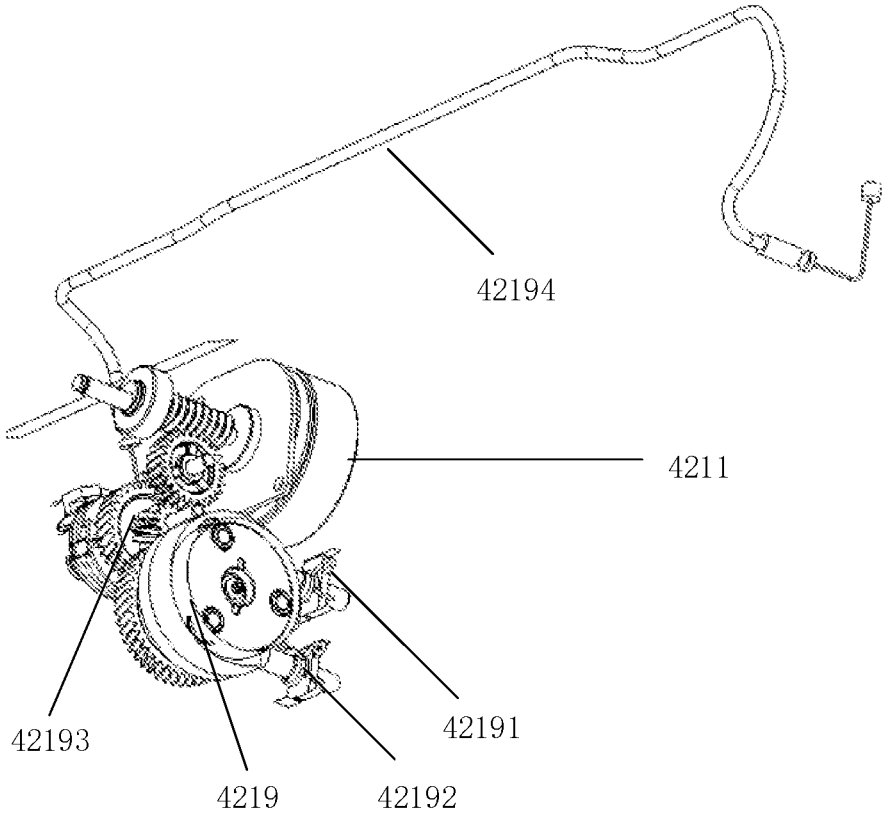
FIG. 17 is a structural diagram of a clean water pump driven by a motor according to an embodiment of the present disclosure.

Further, as shown in FIG. 17, the motor 4211 drives the clean water pump 4219 to wriggle through a gear set 42193. Through the wriggle of the clean water pump 4219, the clean water enters from a water inlet 42191, flows out of a water outlet 42192, and is then transported to the water discharging device 4217 through the clean water pump pipe 4218. The water flowing out of the water discharging device 4217 flows to the cleaning head 410 via the water discharging hole.

Figure 18:
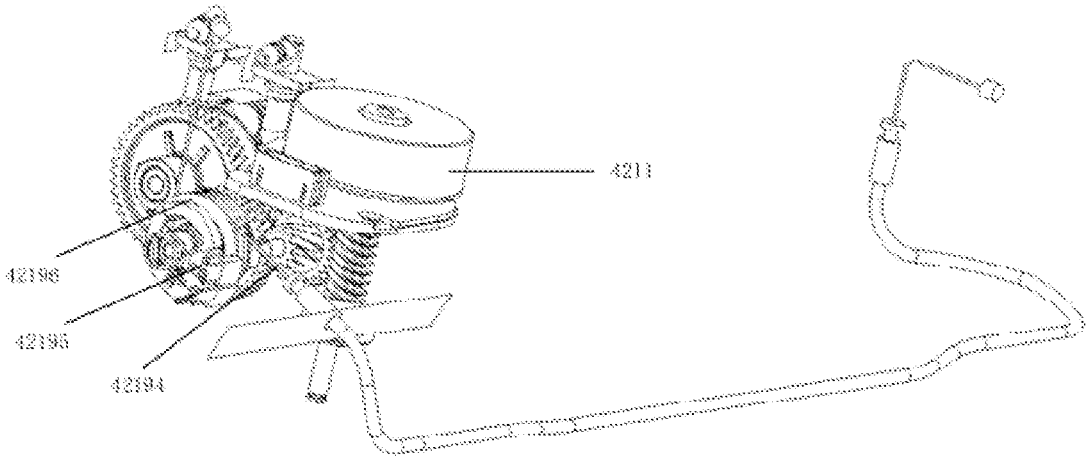
FIG. 18 is a structural diagram of a lifting and lowering module driven by a motor according to an embodiment of the present disclosure.

Further, as shown in FIG. 18, the motor 4211 drives a cable gear 42196 to rotate through the gear set 42193. A cable 42194 is wound on the cable gear 42196, and is wound and suspended on the driving platform 421, and the cable gear 42196 pulls the cable 42196 to rise and drop so as to lift and lower the driving platform 421. The cable gear 42196 and the cable 42194 are core components of the lifting and lowering module.

A clutch 42195 is disposed on the gear set 42193 and the cable gear 42196. By controlling the engagement and disengagement of the clutch 42195, the motor 4211 controls three motion modules, the motor 4211 rotates in one direction to drive the vibrating member to vibrate and enable the clean water pump 4219 to supply water simultaneously; and rotates in an opposite direction to drive the lifting and lowering module to lift and lower through the cable 42194. Optionally, the combined design of the gear set realizes the control of the three motion modules in different combinations, for example, rotating the clean water pump in one direction to supply water, and rotating in the opposite direction to control the lifting and lowering and vibration. Optionally, two motors may also be used to control the three motion modules, but an extra motor also increases the cost.

Since the cleaning module of the automatic cleaning apparatus is provided with the dry cleaning module and the wet cleaning module, a more comprehensive cleaning function can be provided. Meanwhile, by adding the driving unit and the vibration region to the wet cleaning module, the cleaning head may reciprocate to repeatedly clean the surface to be cleaned. Therefore, in a movement trajectory of a cleaning robot, a certain region may be cleaned several times by the cleaning robot passing the region just one time, thereby greatly enhancing the cleaning effect. The cleaning effect is obvious especially for a region with more stains.

Figure 19:
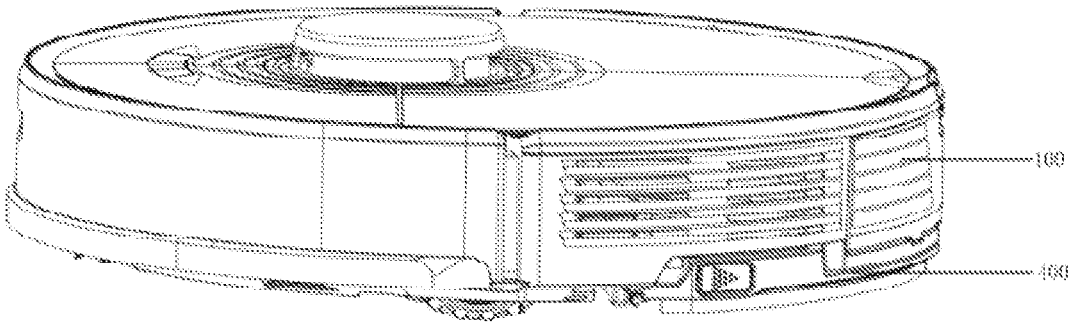
FIG. 19 is a schematic diagram of an automatic cleaning apparatus in a lifting state according to an embodiment of the present disclosure.
Figure 20:
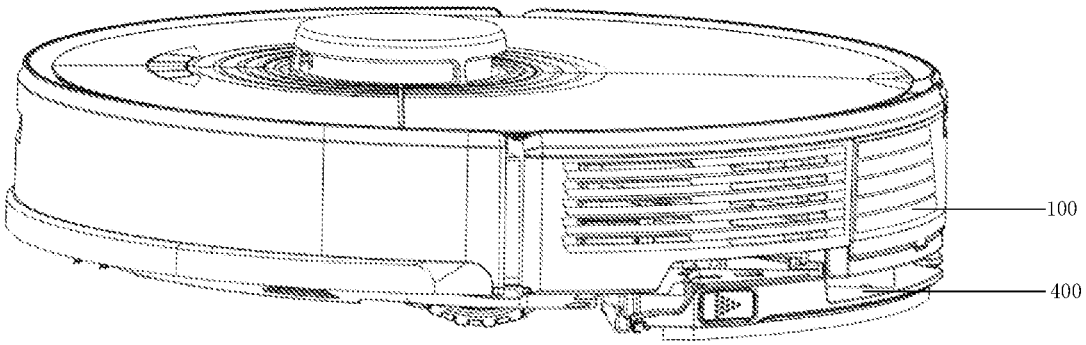
FIG. 20 is a schematic diagram of an automatic cleaning apparatus in a lowering state according to an embodiment of the present disclosure.

As shown in FIGS. 19-20, the wet cleaning module 400 is movably connected to the moving platform 100 through a four-link lifting and lowering structure 500, and configured to clean at least a part of the operating surface by means of wet cleaning. The four-link lifting and lowering structure 500 is a parallelogram structure for switching the wet cleaning module 400 between a lifting state and a lowering state. In the lifting state, the wet cleaning module 400 leaves the operating surface, as shown in FIG. 19, and in the lowering state, the wet cleaning module 400 is attached to the operating surface, as shown in FIG. 20.

Figure 21:
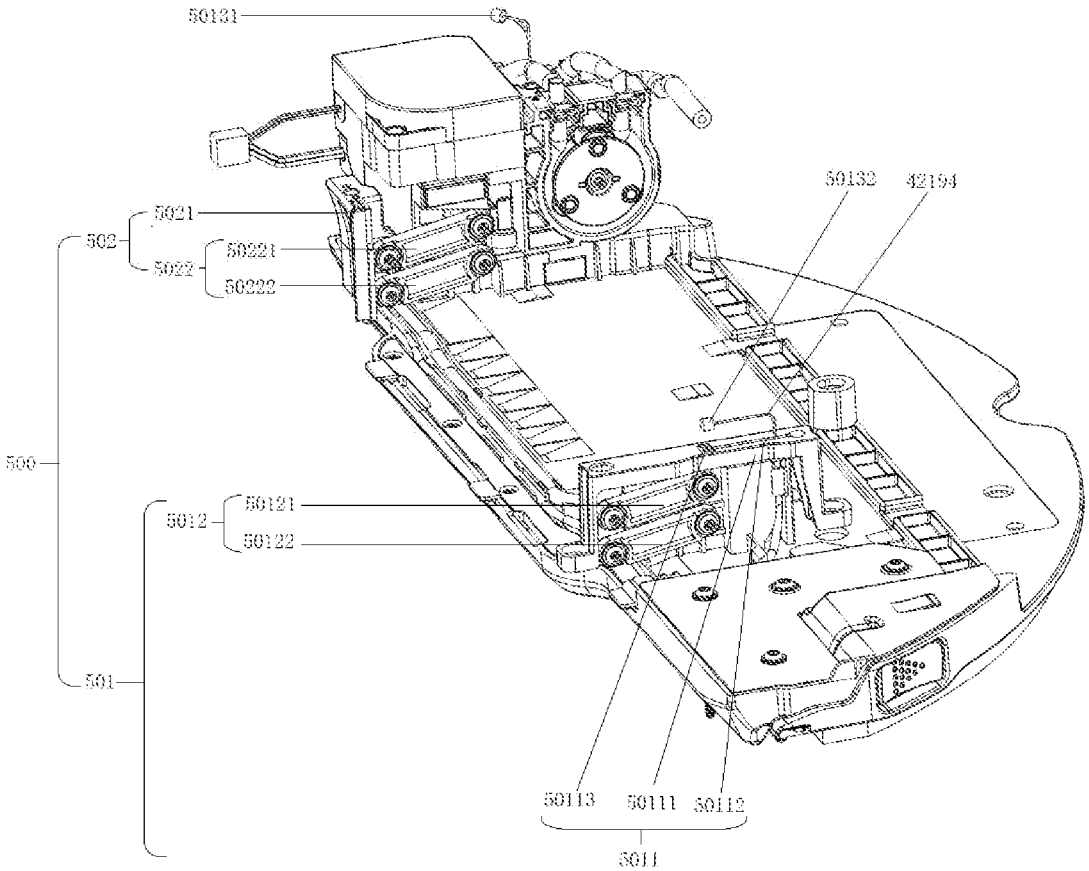
FIG. 21 is a schematic diagram of a four-link lifting and lowering structure in a lifting state according to an embodiment of the present disclosure.
Figure 22:
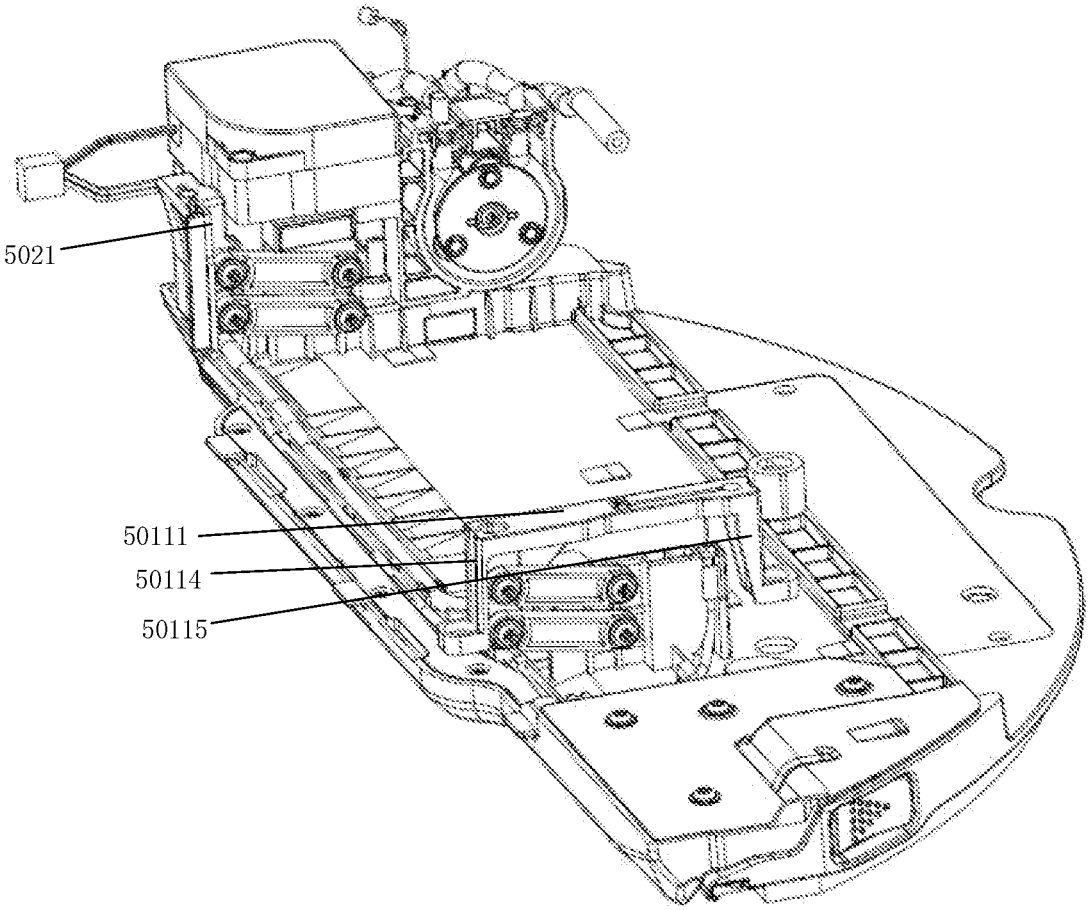
FIG. 22 is a schematic diagram of a four-link lifting and lowering structure in a lowering state according to an embodiment of the present disclosure.

As shown in FIGS. 21-22, the four-link lifting and lowering structure 500 includes: a first connecting end 501 for providing active power to switch the wet cleaning module 400 between the lifting state and the lowering state; and a second connecting end 502 disposed opposite to the first connecting end 501 and rotating under the action of the active power. The first connecting end 501 and the second connecting end 502 are located on both sides of the wet cleaning module 400 respectively to lift or lower the wet cleaning module 400 by stably providing a lifting or lowering force.

Specifically, the first connecting end 501 includes a first bracket 5011 fixedly connected to the bottom of the moving platform 100. The first bracket 5011 is roughly shaped like a Chinese character "几", and includes a cross beam 50111, a first longitudinal beam 50114 and a second longitudinal beam 50115. A tail end of each of the first longitudinal beam 50114 and the second longitudinal beam 50115 is fixedly connected to the moving platform 100 through a bolt to provide a supporting force when the wet cleaning module 400 is lifted and lowered.

The first connecting end 501 further includes a first connecting rod pair 5012, one end of which is rotatably connected to the first bracket 5011, and the other end of which is rotatably connected to the wet cleaning module 400. The first connecting rod pair 5012 may be of a hollowed-out structure, which can reduce an overall weight of lifting and lowering ends.

Optionally, the first connecting rod pair 5012 includes a first connecting rod 50121 and a second connecting rod 50122 which are arranged in parallel. A first end of each of the first connecting rod 50121 and the second connecting rod 50122 is rotatably connected to the first longitudinal beam 50114 through a movable stud, and a second end of each of the first connecting rod 50121 and the second connecting rod 50122 is rotatably connected to the wet cleaning module 400 through a movable stud. For example, both ends of each of the first connecting rod 50121 and the second connecting rod 50122 are provided with a through hole having a diameter greater than that of the movable stud, respectively, so that the movable stud may rotate freely within the through hole, and is fixedly connected to the first longitudinal beam 50114 through the through hole. When the motor 4211 provides a pulling force to the first ends through the cable, the first ends of the first connecting rod 50121 and the second connecting rod 50122 simultaneously rotate around the movable studs at the first ends, and the second ends thereof are lifted under the pulling force of the cable, so that the wet cleaning module 400 is lifted. When the motor 4211 releases the pulling force to the first ends through the cable, the first ends of the first connecting rod 50121 and the second connecting rod 50122 simultaneously rotate reversely around the movable studs at the first ends, and the second ends thereof are lowered under the action of gravity, so that the wet cleaning module 400 is lowered.

The lifting and lowering structure 500 further includes a cable 42194 for providing a pulling force to rotate the first connecting rod pair 5012 within a preset angle. The cable 42194 includes a cable motor terminal 50131 connected to the driving unit 420, for example, wound on the gear connected to the motor output shaft to extend and retract under the rotation of the motor; and a cable bracket terminal 50132 connected to the first bracket 5011. The motor lifts or lowers the second ends of the first connecting rod 50121 and the second connecting rod 50122 through the cable 42194.

Optionally, the first bracket 5011 further includes: a sliding slot 50112 extending along a surface of the cross beam 50111; and a snapping hole 50113 running through the cross beam 50111 and disposed at an extension end of the sliding slot 50112 for accommodating and snapping the cable bracket terminal 50132. The cable 42194 is connected to the first ends of the first connecting rod 50121 and the second connecting rod 50122 through the sliding slot 50112 and the snapping hole 50113. The sliding slot 50112 can restrict a moving direction of the cable to ensure the stability of the lifting and lowering module, and it is appropriate that the width of the sliding slot matches the thickness of the cable.

As shown in FIG. 21, the second connecting end 502 includes: a second bracket 5021 fixedly connected to the bottom of the moving platform 100; and a second connecting rod pair 5022, one end of which is rotatably connected to the second bracket 5021, and the other end of which is rotatably connected to the wet cleaning module 400. The second connecting rod pair 5022 rotates along with the rotation of the first connecting rod pair 5012. The second connecting rod pair 5022 may be of a hollowed-out structure, which can reduce the overall weight of lifting and lowering ends.

Specifically, the second connecting rod pair 5022 includes a third connecting rod 50221 and a fourth connecting rod 50222 which are arranged in parallel. A first end of each of the third connecting rod 50221 and the fourth connecting rod 50222 is rotatably connected to the second bracket 5021 through a movable stud, and a second end of each of the third connecting rod 50221 and the fourth connecting rod 50222 is rotatably connected to the wet cleaning module 400 through a movable stud. For example, both ends of each of the third connecting rod 50221 and the fourth connecting rod 50222 are provided with a through hole having a diameter greater than that of the movable stud, respectively, so that the movable stud may rotate freely within the through hole, and is fixedly connected to the second bracket 5021 and the wet cleaning module 400 through the through hole. When the first connecting end 501 rotates under the driving of the motor 4211, the first ends of the third connecting rod 50221 and the fourth connecting rod 50222 simultaneously rotate around the movable studs at the first ends, and the second ends of the third connecting rod 50221 and the fourth connecting rod 50222 simultaneously rotate around the movable studs at the second ends, so that the wet cleaning module 400 is lifted. When the pulling force to the first connecting end 501 is released, the third connecting rod 50221 and the fourth connecting rod 50222 simultaneously rotate reversely around the movable studs, and are lowered under the action of gravity, so that the wet cleaning module 400 is lowered.

Through the four-link lifting and lowering structure disposed between the wet cleaning module and the moving platform, the wet cleaning module may be lifted and lowered relative to the moving platform. When a ground mopping task is performed, the wet cleaning module is lowered to enable the wet cleaning module to be in contact with the ground; and when the ground mopping task is completed, the wet cleaning module is lifted to separate the wet cleaning module from the ground, thereby avoiding the increased resistance due to the existence of the cleaning module when the cleaning apparatus moves freely on the surface to be cleaned.

In cooperation with a surface medium sensor and other sensors that can detect a surface type of the surface to be cleaned, the lifting and lowering module enables the wet cleaning module to perform a cleaning operation according to different surfaces to be cleaned. For example, the lifting and lowering module lifts the wet cleaning module in case of a carpet surface, and lowers the wet cleaning module in case of a floor surface, a floor tile surface or the like, for cleaning. Thus, a more comprehensive cleaning effect is achieved.

Figure 23:
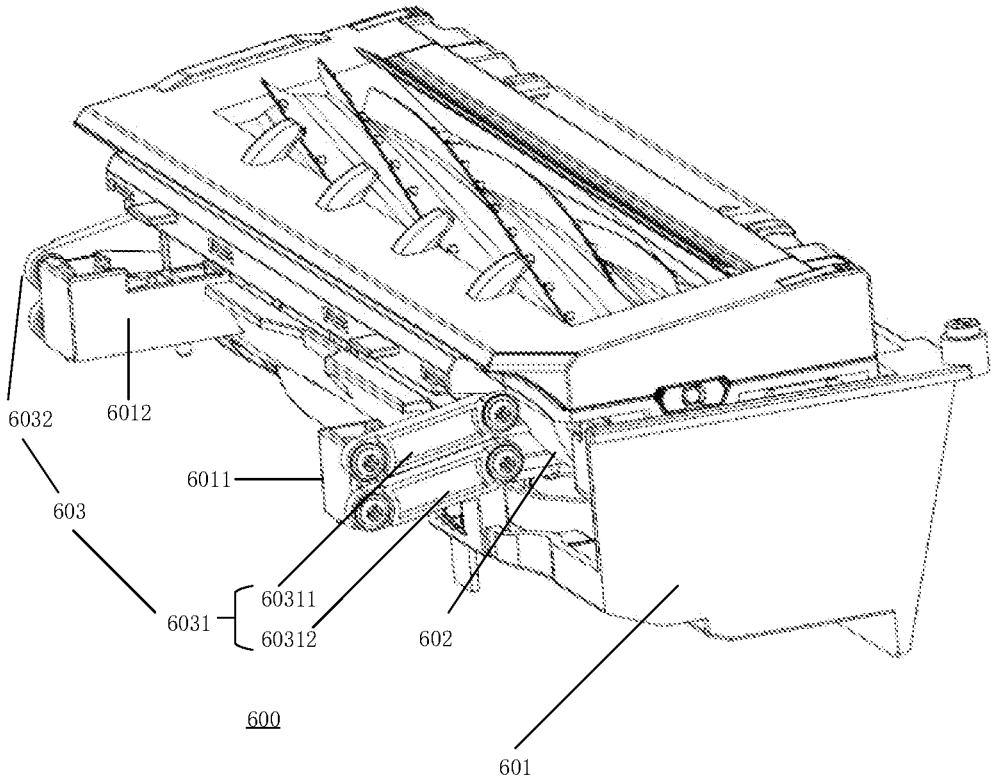
FIG. 23 is a schematic structural diagram of a dry cleaning module in a lowering state according to an embodiment of the present disclosure.

As shown in FIG. 23, which is a diagram of the dry cleaning module 151 in a lifting state, a floating lifting and lowering structure 600 is connected to the dry cleaning module 151 and configured to enable the dry cleaning module 151 to passively move vertically relative to the moving platform 100. Specifically, the floating lifting and lowering structure 600 is a parallelogram four-link lifting and lowering structure configured to passively switch the dry cleaning module 151 between a lifting state and a lowering state under the action of an external force.

Optionally, the floating lifting and lowering structure 600 includes: a first fixed bracket 601 fixedly connected to the moving platform 100; a second fixed bracket 602 fixedly connected to the dry cleaning module 151; and a connecting rod pair 603, one end of which is rotatably connected to the first fixed bracket 601 through a movable stud, and the other end of which is rotatably connected to the second fixed bracket 602 through a movable stud. The first fixed bracket 601 and the second fixed bracket 602 are connected through a flexible connecting member. When encountering an obstacle, the dry cleaning module 151 is pushed upward, and the first fixed bracket 601 rotates around the connecting rod pair 603 and then retracted upward relative to the second fixed bracket 602, so as to realize passive lifting. After passing the obstacle, the dry cleaning module 151 falls under the action of gravity and comes into contact with the operating surface, and the cleaning apparatus continues to move forward for performing the cleaning task. With the parallelogram four-link lifting and lowering structure, the cleaning apparatus can pass the obstacle more flexibly, and is less liable to damage.

Optionally, the connecting rod pair 603 includes: a first connecting rod pair 6031, one end of which is rotatably connected to a first end of the first fixed bracket 601 through a movable stud, and the other end of which is rotatably connected to a first end of the second fixed bracket 602 through a movable stud; and a second connecting rod pair 6032 disposed opposite to the first connecting rod pair 6031, one end of which is rotatably connected to a second end of the first fixed bracket 601 through a movable stud, and the other end of which is rotatably connected to a second end of the second fixed bracket 602 through a movable stud. The first connecting rod pair 6031 or the second connecting rod pair 6032 may be of a hollowed-out structure, which can reduce the overall weight of lifting and lowering ends.

Optionally, the first connecting rod pair 6031 includes a first connecting rod 60311 and a second connecting rod 60312 which are arranged in parallel. One end of each of the first connecting rod 60311 and the second connecting rod 60312 is provided with a first shaft hole, and the other end thereof is provided with a second shaft hole. The movable studs rotatably fix the first connecting rod 60311 and the second connecting rod 60312 to the first end of the first fixed bracket 601 through the first shaft holes, and the movable studs rotatably fix the first connecting rod 60311 and the second connecting rod 60312 to the first end of the second fixed bracket 602 through the second shaft holes. For example, both ends of each of the first connecting rod 60311 and the second connecting rod 60312 are provided with a through hole (not shown) having a diameter greater than that of the movable stud, respectively, so that the movable stud may rotate freely within the through hole, and is fixedly connected to the first fixed bracket 601 through the through hole. When encountering a raised obstacle, the dry cleaning module 151 is pushed upward under the action of the obstacle, the first ends of the first connecting rod 60311 and the second connecting rod 60312 simultaneously rotate around the movable studs at the first ends, and the second ends of the first connecting rod 60311 and the second connecting rod 60312 simultaneously rotate around the movable studs at the second ends, so that the dry cleaning module 151 is lifted. When passing the obstacle, the dry cleaning module 151 falls under the action of gravity and comes into contact with the operating surface.

Figure 24:
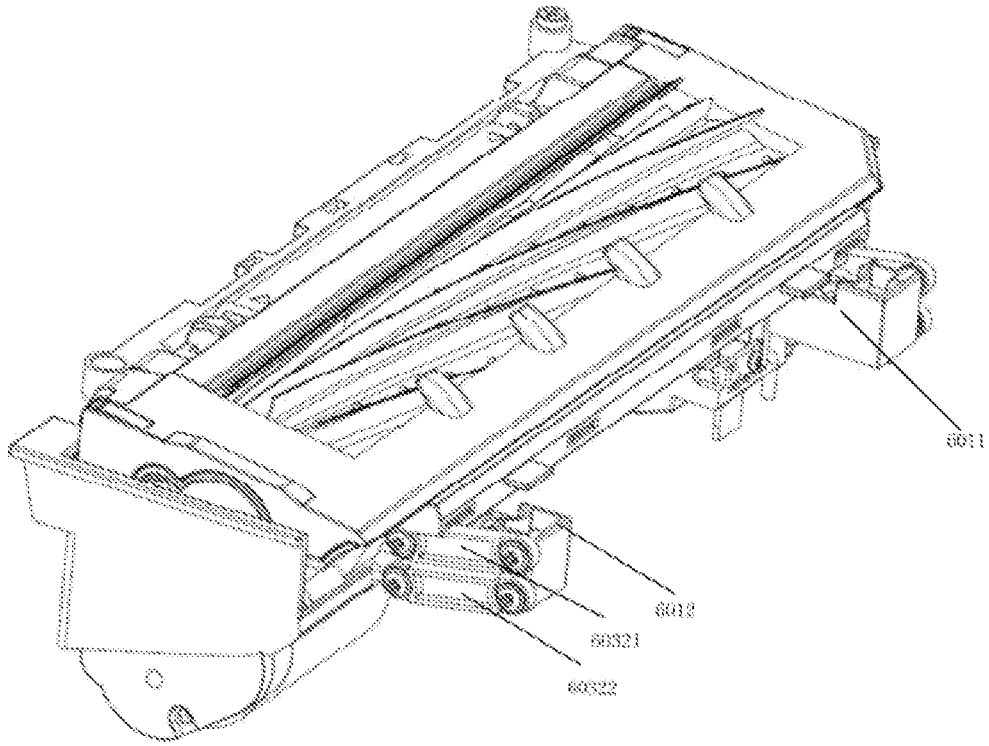
FIG. 24 is a schematic structural diagram of a dry cleaning module in a lifting state according to an embodiment of the present disclosure.

Optionally, as shown in FIG. 24, which is a diagram of the dry cleaning module 151 in a lifting state. The second connecting rod pair 6032 includes a third connecting rod 60321 and a fourth connecting rod 60322 which are arranged in parallel. One end of each of the third connecting rod 60321 and the fourth connecting rod 60322 is provided with a third shaft hole, and the other end thereof is provided with a fourth shaft hole. The movable studs rotatably fix the third connecting rod 60321 and the fourth connecting rod 60322 to the second end of the first fixed bracket 601 through the third shaft holes, and the movable studs rotatably fix the third connecting rod 60321 and the fourth connecting rod 60322 to the second end of the second fixed bracket 602 through the fourth shaft holes. For example, both ends of each of the third connecting rod 60321 and the fourth connecting rod 60322 are provided with a through hole (not shown) having a diameter greater than that of the movable stud, respectively, so that the movable stud may rotate freely within the through hole, and is fixedly connected to the first fixed bracket 601 through the through hole. When encountering a raised obstacle, the dry cleaning module 151 is pushed upward under the action of the obstacle, the first ends of the third connecting rod 60321 and the fourth connecting rod 60322 simultaneously rotate around the movable studs at the first ends, and the second ends of the third connecting rod 60321 and the fourth connecting rod 60322 simultaneously rotate around the movable studs at the second ends, so that the dry cleaning module 151 is lifted. When passing the obstacle, the dry cleaning module 151 falls under the action of gravity and comes into contact with the operating surface.

As an optional embodiment, the first fixed bracket 601 includes: a first fixed portion 6011 protruding from the first fixed bracket 601 and extending laterally outward for carrying the first connecting rod pair 6031; and a second fixed portion 6012 disposed symmetrically with the first fixed portion 6011 for carrying the second connecting rod pair 6032. The first fixed portion 6011 and the second fixed portion 6012 are used to support the connecting rod pairs in a protruding manner, so that the connecting rod pairs may rotate freely to ensure the free lifting and lowering of the dry cleaning module 151.

Optionally, the floating lifting and lowering structure 600 further includes a flexible connecting member (not shown) connected between the first fixed bracket 601 and the second fixed bracket 602. When the operating surface is uneven, the second fixed bracket 602 moves vertically relative to the first fixed bracket 601 through the flexible connecting member.

In the dry cleaning module, the four-link floating lifting and lowering structure is disposed to enable the dry cleaning module to passively move vertically relative to the moving platform. When encountering an obstacle during operation, the cleaning apparatus can easily pass the obstacle through the four-link floating lifting and lowering structure, thereby avoiding the damage to the cleaning apparatus by the obstacle.

Second Embodiment

According to specific embodiments of the present disclosure, the present disclosure provides an automatic cleaning apparatus. Structures in this embodiment that are the same as those in the above embodiment have same functions or effects, which will not be repeated herein. Specifically, the automatic cleaning apparatus includes: a moving platform 100 configured to move automatically on an operating surface; and a cleaning module 150 disposed on the moving platform 100 and including: a dry cleaning module 151 configured to clean at least a part of the operating surface by means of dry cleaning; and a wet cleaning module 400 configured to clean at least a part of the operating surface by means of wet cleaning, where the wet cleaning module 400 includes: a cleaning head 410 for cleaning the operating surface, and a driving unit 420 for driving the cleaning head 410 to reciprocate along a target surface, the target surface being a part of the operating surface, where a width of a lateral cleaning area of the cleaning head 410 is smaller than a width of a lateral cleaning area of the dry cleaning module 151. Therefore, when the automatic cleaning apparatus is moving, the width of the dry cleaning module located in front of the traveling route is large, while the width of the wet cleaning module located at the rear of the traveling route is small, so that there will be no wet cleaning if dust and garbage on the ground are not cleaned by the dry cleaning module, so as to avoid making the floor more dirty.

As an optional implementation, the driving unit 420 includes: a driving platform 421 connected to a bottom surface of the moving platform 100 for providing a driving force; a supporting platform 422 detachably connected to the driving platform 421 for supporting the cleaning head 410. The supporting platform 422 includes: a cleaning substrate 4221, which is freely movable on the supporting platform 422, and the cleaning substrate 4221 drives the cleaning head 410 to substantially reciprocate within the width of the lateral cleaning area. The width of the lateral cleaning area refers to the width perpendicular to the direction of travel of the cleaning apparatus. This width is the width of the interval at which the cleaning head 410 can reach the widest position when it substantially reciprocates. The cleaning head 410 may not reach the edge of the interval width every time it reciprocates.

As an optional implementation, the cleaning substrate 4221 includes at least two first limiting positions 42212, and the at least two first limiting positions 42212 are respectively arranged on both sides of a traveling direction of the cleaning substrate 4221. For example, it includes, but is not limited to, four first limiting positions 42212, with two on both sides of the cleaning substrate 4221. Optionally, the first limiting position 42212 is flexibly connected to the cleaning substrate 4221. For example, by setting the first limiting position 42212 as an elastic structure for flexible connection, since the movable substrate does not completely move in a straight line when it reciprocates, the first limiting position 42212 needs to be used to limit its displacement in the longitudinal direction.

As an optional implementation, the cleaning substrate 4221 includes at least two second limiting positions 42213, the at least two second limiting positions 42213 are arranged on both sides of the cleaning substrate 4221 in a direction perpendicular to the traveling direction, and the at least two second limiting positions 42213 make the cleaning head 410 substantially reciprocate within the width of the lateral cleaning area. Optionally, buffer pads are provided on the side of the at least two second limiting positions 42213 facing the cleaning substrate 4221, so as to prevent the cleaning substrate 4221 from being damaged when it comes into contact with the second limiting positions 42213.

Optionally, a distance between the at least two second limiting positions 42213 is smaller than the width of the lateral cleaning area.

Optionally, the driving platform 421 includes: a motor 4211, which is arranged on a side of the driving platform 421 close to the moving platform 100, and outputs power through a motor output shaft; a cam 4212 connected with the motor output shaft, where the cam 4212 has an asymmetric structure; a vibrating rod 4213 which is arranged on a side of the driving platform 421 opposite to the motor 4211, connected with the cam 4212, and reciprocates under the asymmetric rotation of the cam 4212.

Optionally, the cleaning substrate 4221 includes: an assembly notch, which is arranged at a position in contact with the vibrating rod 4213. When the supporting platform 422 is connected to the driving platform 421, the vibrating rod 4213 is assembled on the assembly notch. Under the action of the vibrating rod 4213, the cleaning head 410 reciprocates within the width of the lateral cleaning area.

The present disclosure provides an automatic cleaning apparatus. The lateral cleaning area width of the cleaning head in the wet cleaning module of the automatic cleaning apparatus is smaller than the lateral cleaning area width of the dry cleaning module. Therefore, when the automatic cleaning apparatus is traveling, the width of the dry cleaning module located in front of the traveling route is large, while the width of the wet cleaning module located at the rear of the traveling route is small, so that there will be no wet cleaning if dust and garbage on the ground are not cleaned by the dry cleaning module, so as to avoid making the floor more dirty. At the same time, in the wet cleaning module, by adding the driving unit and the vibration region, the cleaning head can reciprocate to clean the surface to be cleaned repeatedly, so that in the motion trajectory of the cleaning robot, it can realize multiple cleaning when passing through a certain area at one time. The cleaning effect is greatly enhanced, especially for areas with more stains, the cleaning effect is obvious.

Finally, it should be noted that various embodiments in the Description are described in a progressive manner, each embodiment focuses on the differences from other embodiments, and the same or similar parts among the various embodiments may refer to one another. Since the system or device disclosed in the embodiment corresponds to the method disclosed in the embodiment, the description is relatively simple, and the relevant parts may refer to the description of the method part.

The above embodiments are only used to illustrate the technical solutions of the present disclosure and are not intended to limit the present disclosure. Although the present disclosure has been described in detail with reference to the foregoing embodiments, those of ordinary skills in the art should understand that, they can still make modifications to the technical solutions described in the foregoing embodiments or make equivalent substitutions to some of the technical features, and these modifications or substitutions do not make the essence of the corresponding technical solutions deviate from the spirit and scope of the technical solutions of the various embodiments of the present disclosure.

What is claimed is:

1. An automatic cleaning apparatus, comprising:

a moving platform configured to move automatically on an operating surface; and a cleaning module disposed on the moving platform, and comprising:

a dry cleaning module configured to clean at least a part of the operating surface by means of dry cleaning, wherein the dry cleaning module comprises a rolling brush, a dust box, and a blower, the rolling brush sweeps up garbage on at least a part of the operating surface and then the garbage is sucked into the dust box by air generated by the blower; and a wet cleaning module configured to clean at least a part of the operating surface by means of wet cleaning, wherein the wet cleaning module comprises:

a cleaning head for cleaning the operating surface, and a driving unit for driving the cleaning head to reciprocate along a target surface, the target surface being a part of the operating surface, wherein a width of a lateral cleaning area of the cleaning head is smaller than a width of a lateral cleaning area of the dry cleaning module;

wherein the driving unit comprises:

a driving platform connected to a bottom surface of the moving platform for providing a driving force;

a supporting platform detachably connected to the driving platform for supporting the cleaning head; and a cleaning substrate, which is freely movable on the supporting platform, and the cleaning substrate drives the cleaning head to substantially reciprocate within the width of the lateral cleaning area of the cleaning head;

wherein the cleaning substrate comprises at least two first limiting position elastic structures, and the at least two first limiting position elastic structures are respectively arranged on both sides of a traveling direction of the cleaning substrate; and wherein the first limiting position elastic structures are flexibly connected to the cleaning substrate.

2. The automatic cleaning apparatus according to claim 1, wherein the cleaning substrate comprises at least two second limiting position structures, and the at least two second limiting position structures are arranged on both sides of the cleaning substrate in a direction perpendicular to the traveling direction, and the at least two second limiting position structures enable the cleaning head to substantially reciprocate within the width of the lateral cleaning area of the cleaning head.

3. The automatic cleaning apparatus according to claim 2, wherein a distance between the at least two second limiting position structures is smaller than the width of the lateral cleaning area of the cleaning head.

4. The automatic cleaning apparatus according to claim 3, wherein the at least two second limiting position structures are provided with buffer pads on one side facing the cleaning substrate.

5. The automatic cleaning apparatus according to claim 1, wherein the driving platform comprises:

a motor arranged on a side of the driving platform close to the moving platform for outputting power through a motor output shaft;

a cam connected with the motor output shaft and having an asymmetric structure; and a vibrating rod arranged on a side of the driving platform opposite to the motor, connected with the cam, and reciprocating under an asymmetrical rotation of the cam.

6. The automatic cleaning apparatus according to claim 5, wherein the cleaning substrate comprises:

an assembly notch arranged at a position in contact with the vibrating rod, wherein when the supporting platform is connected to the driving platform, the vibrating rod is assembled in the assembly notch, and under an action of the vibrating rod, the cleaning head reciprocates within the width of the lateral cleaning area of the cleaning head.

* * * * *